US008893360B2

(12) United States Patent
Ogawa et al.

(10) Patent No.: US 8,893,360 B2
(45) Date of Patent: Nov. 25, 2014

(54) METHOD FOR MANUFACTURING MOTOR VEHICLE DOOR HINGE

(75) Inventors: Hiroshi Ogawa, Hashimoto (JP); Kazuya Ogawa, Hashimoto (JP); Michihiro Yokoyama, Tokyo (JP)

(73) Assignees: Hiroshi Ogawa, Wakayama (JP); Kazuya Ogawa, Wakayama (JP)

( * ) Notice: Subject to any disclaimer, the term of this patent is extended or adjusted under 35 U.S.C. 154(b) by 60 days.

(21) Appl. No.: 13/618,729

(22) Filed: Sep. 14, 2012

(65) Prior Publication Data

US 2013/0061437 A1 Mar. 14, 2013

Related U.S. Application Data

(63) Continuation of application No. PCT/JP2011/055321, filed on Mar. 8, 2011.

(30) Foreign Application Priority Data

Mar. 24, 2010 (JP) ..... 2010-067801

(51) Int. Cl.

| | |
|---|---|
| ***B21D 53/40*** | (2006.01) |
| ***B21K 13/02*** | (2006.01) |
| ***E05D 5/02*** | (2006.01) |
| ***B21K 1/76*** | (2006.01) |
| ***B21D 28/32*** | (2006.01) |

(52) U.S. Cl.

CPC . *B21K 1/76* (2013.01); *B21K 13/02* (2013.01); *B21D 28/32* (2013.01); *B21D 53/40* (2013.01)

USPC ..... 29/11; 72/377; 16/387

(58) Field of Classification Search

CPC ..... E05D 3/00; E05D 3/02; E05D 5/02; E05D 5/0207; E05D 5/06; E05D 11/10; E05D 2700/02; E05D 2003/02; E05D 11/1057; B21D 53/40

USPC ..... 29/11; 16/387, 389, 254; 72/377, 333, 72/335, 341

See application file for complete search history.

(56) References Cited

U.S. PATENT DOCUMENTS 380,668 A * 4/1888 Strom ..... 72/377
1,708,202 A * 4/1929 Welsh et al. ..... 29/11

(Continued)

FOREIGN PATENT DOCUMENTS

EP 054522 A2 * 6/1982 ..... B21D 53/40
GB 2080403 A * 2/1982 ..... E05D 5/02

(Continued)

OTHER PUBLICATIONS

International Search Report issued Jun. 28, 2011 in International Application No. PCT/JP2011/055321.

*Primary Examiner* — Essama Omgba

(74) *Attorney, Agent, or Firm* — Wenderoth, Lind & Ponack, L.L.P.

(57) ABSTRACT

A method for manufacturing a high-strength motor vehicle door hinge from a steel plate blank includes a cold heading step of forming a cylindrical bulging portion at one end of the blank in the width direction, a shaft hole forming step of forming a shaft hole in the cylindrical bulging portion, and a shaft hole finishing step. In the shaft hole forming step, a shaft hole is formed using a first punch having a top end with a shape of a cone and a first die having an inner wall with a gap volume relative to the outer circumferential surface of the cylindrical bulging portion of the blank.

11 Claims, 28 Drawing Sheets

(56) References Cited

U.S. PATENT DOCUMENTS

| | | | | | |
|---|---|---|---|---|---|
| 2,028,385 | A | * | 1/1936 | Eden, Jr. | 29/11 |
| 2,235,241 | A | * | 3/1941 | Tierney | 16/392 |
| RE21,876 | E | * | 8/1941 | Tierney | 16/392 |
| 2,301,095 | A | * | 11/1942 | Tierney | 16/379 |
| 2,345,562 | A | * | 4/1944 | Atwood | 29/11 |
| 3,387,350 | A | * | 6/1968 | Ando | 29/11 |
| 3,432,899 | A | * | 3/1969 | Morton | 29/11 |
| 6,173,475 | B1 | * | 1/2001 | Senn et al. | 16/273 |
| 6,536,256 | B2 | * | 3/2003 | Hauger | 72/348 |
| 2006/0174445 | A1 | | 8/2006 | Kim | |
| 2011/0258812 | A1 | * | 10/2011 | Oetlinger | 16/382 |
| 2013/0276276 | A1 | * | 10/2013 | Ogawa et al. | 29/11 |

FOREIGN PATENT DOCUMENTS

| | | | | | |
|---|---|---|---|---|---|
| JP | 50-137354 | | | 10/1975 | |
| JP | 56068541 | A | * | 6/1981 | B21K 13/02 |
| JP | 56-117850 | | | 9/1981 | |
| JP | 6-240943 | | | 8/1994 | |
| JP | 8-197952 | | | 8/1996 | |
| JP | 2005-205498 | | | 8/2005 | |
| JP | 2005-238326 | | | 9/2005 | |
| JP | 2006-68836 | | | 3/2006 | |
| JP | 2006-170331 | | | 6/2006 | |
| JP | 2006-214259 | | | 8/2006 | |
| JP | 2008-223247 | | | 9/2008 | |

* cited by examiner 23
2a
30a (30)
32
23
2a
31

3
4
5
2a 32
35

33
31

34
36

2a
32
33
34
31
30b (30)
32
2a 2a
32
31
33
34
31
30c (30)
32
2a 2a
2a
2a
37
32
2a
32
37
30d (30)

2a
5
4

METHOD FOR MANUFACTURING MOTOR VEHICLE DOOR HINGE

This application is a continuation of International Application No. PCT/JP2011/055321, filed Mar. 8, 2011, the contents of which are incorporated herein by reference in their entirety.

TECHNICAL FIELD

The present invention relates to a method for manufacturing a motor vehicle door hinge from a steel plate blank having predetermined thickness, width, and height using cold heading or punching and, in particular, to a technology relating to a method for manufacturing a motor vehicle door hinge having a sufficient strength at low manufacturing cost by forming, at one end of the blank in the width direction, a cylindrical bulging portion having a horizontal cross section of a circular or elliptical shape and extending in the height direction by cold heading and forming, in the cylindrical bulging portion, a shaft hole along the center axis of the cylindrical bulging portion, where the shaft hole allows a hinge pin to be inserted thereinto using a special die and a special punch so that the height of the shaft hole is twice or more the diameter of the shaft hole.

BACKGROUND ART

Existing motor vehicle door hinges are manufactured from a sheet metal since motor vehicle door hinges can be manufactured by using, for example, press forming at low cost (refer to, for example, PTL 1).

Alternatively, since the strength of existing motor vehicle door hinges formed from a sheet metal is low, door hinges of full-sized cars and high-end cars are manufactured from a mold steel. At that time, a mold steel formed through an extrusion process is used and is cut into pieces each having a desired length. The piece is formed into a desired shape through a cutting work (refer to, for example, PTL 2).

CITATION LIST

Patent Literature

PTL 1: Japanese Unexamined Patent Application Publication No. 8-197952 (Paragraph 0012 and FIG. 2)

PTL 2: Japanese Unexamined Patent Application Publication No. 2008-223247 (Paragraph 0002 and FIG. 4)

SUMMARY OF INVENTION

Technical Problem

The sheet metal motor vehicle door hinge described in PTL 1 has a bend portion with a small thickness. In addition, a large bending moment acts on the bend portion. Accordingly, damage of the door hinge easily occurs due to an impact caused by opening and closing of the door.

Furthermore, since a hinge shaft that connects a door-side door hinge to a chassis-side door hinge is disposed so as to be exposed to the outside, the hinge shaft is mostly stressed when the door is rotated and, therefore, damage of the door hinge easily occurs.

As described above, although a sheet metal motor vehicle door hinge is manufactured at low cost, the strength is low, which is problematic.

In addition, the motor vehicle door hinge formed through a cutting work described in PTL 2 has a sufficient strength. However, the manufacturing cost of the mold steel formed through an extrusion process is high. In addition, the cost of the cutting process is high. Therefore, the total cost is high, which is problematic.

Accordingly, the present invention is intended to solve such problems arising in the existing structure. An object of the present invention is to provide a method for manufacturing a motor vehicle door hinge having a sufficient strength from a steel plate blank by, for example, cold heading and punching at low manufacturing cost.

Solution to Problem

According to a first aspect of the present invention, a method for manufacturing a motor vehicle door hinge from a steel plate blank having predetermined thickness, width, and height using processes including cold heading and punching is provided.

The method includes a cold heading step of forming, at one end of the blank in the width direction, a cylindrical bulging portion having a cylindrical bulging shape bulging in the thickness direction so as to have a horizontal cross section of a circular shape or an elliptical shape and extending in the height direction by cold heading, a shaft hole forming step of forming a shaft hole that passes through the cylindrical bulging portion along the shaft axis using a first punch and a first die, the shaft hole allowing a hinge pin to pass therethrough, and a shaft hole finishing step of punching the shaft hole formed in the shaft hole forming step from the end at which machining of the first punch ends using a second punch and a second die.

A height of the cylindrical bulging portion of the shaft hole formed in the shaft hole forming step is twice or more a diameter of the shaft hole.

The first punch used in the shaft hole forming step has a top end having a shape of a cone with a cone angle in the range from 70° to 120°.

The first die has an inner wall having a gap relative to an outer circumferential surface of the cylindrical bulging portion of the blank, and the size of a gap volume formed by the outer circumferential surface of the cylindrical bulging portion and the inner wall is set so that when the first punch punches the cylindrical bulging portion of the blank, a hole portion formed from the end at which machining of the first punch starts to a predetermined length position does not produce a punched slug, the cylindrical bulging portion bulges outward, and a hole portion from the predetermined length position to the end at which the machining of the first punch ends produces a punched slug to be ejected.

The second die has a shape substantially the same as the shape of the first die.

The second punch has a top end having a shape of a truncated cone or a cone with a cone angle in the range from 70° to 120° and the largest diameter that is larger than that of the first punch by 0.1 mm to 0.3 mm.

According to a second aspect of the present invention, a method for manufacturing a motor vehicle door hinge from a steel plate blank having predetermined thickness, width, and height using processes including cold heading and punching is provided.

The method includes a cold heading step of forming, at one end of the blank in the width direction, a protrusion attached cylindrical bulging portion having a protrusion attached cylindrical bulging shape that bulges in the thickness direction so as to have a horizontal cross section of a circular shape or an elliptical shape and that extends in the height direction and having a protrusion on the top end of the circular shape by cold heading, where the protrusion serves as a door stopper, a shaft hole forming step of forming a shaft hole that passes through the cylindrical bulging portion along the shaft axis using a first punch and a first die, where the shaft hole allows a hinge pin to pass therethrough, and a shaft hole finishing step of punching the shaft hole formed in the shaft hole forming step from the end at which machining of the first punch ends using a second punch and a second die.

The first punch used in the shaft hole forming step has a top end having a shape of a cone with a cone angle in the range from 70° to 120°.

The height of the protrusion attached cylindrical bulging portion of the shaft hole formed in the shaft hole forming step is twice or more a diameter of the shaft hole.

The first die has an inner wall having a gap relative to an outer circumferential surface of the protrusion attached cylindrical bulging portion of the blank. The size of a gap volume formed by the outer circumferential surface of the protrusion attached cylindrical bulging portion and the inner wall is set so that when the first punch punches the protrusion attached cylindrical bulging portion of the blank, a hole portion formed from an end at which machining of the first punch starts to a predetermined length position does not produce a punched slug and the protrusion attached cylindrical bulging portion bulges outward and a hole portion from the predetermined length position to the end at which the machining of the first punch ends produces a punched slug to be ejected.

The second die has a shape substantially the same as the shape of the first die, and the second punch has a top end having a shape of a truncated cone or a cone with a cone angle in the range from 70° to 120° and the largest diameter that is larger than that of the first punch by 0.1 mm to 0.3 mm.

According to a third aspect of the present invention, in addition to the configuration according to the first or second aspects of the present invention, the method for manufacturing a motor vehicle door hinge includes an annealing step of performing one of spheroidizing annealing and soft annealing on the blank after the cold heading step and before the shaft hole forming step.

The shaft hole forming step is performed by cold working.

According to a fourth aspect of the present invention, in addition to the configuration according to the first or second aspects of the present invention, in the shaft hole forming step of the method for manufacturing a motor vehicle door hinge, one of the cylindrical bulging portion and the protrusion attached cylindrical bulging portion is subjected to warm working at a temperature in the range from 450° C. to 900° C.

According to a fifth aspect of the present invention, in addition to the configuration according to any one of the first to fourth aspects of the present invention, the method for manufacturing a motor vehicle door hinge further includes a wall thickness increasing step of sandwiching one of the cylindrical bulging portion and the protrusion attached cylindrical bulging portion formed at one end of the blank by a split mold die having a back clearance that allows the middle portion of the blank to bulge in the thickness direction so that the other end protrudes from the split mold die and increasing a wall thickness of the middle portion of the blank by pressing the other end of the blank using a punch and a bending step of bending a thick-wall portion of the blank formed in the wall thickness increasing step into an L shape using press working. The shaft hole forming step and the shaft hole finishing step are performed after the wall thickness increasing step is performed. After the shaft hole finishing step is performed, the bending step is performed.

According to a sixth aspect of the present invention, in addition to the configuration according to any one of the first to fifth aspects of the present invention, the method for manufacturing a motor vehicle door hinge further includes a bending step of bending the middle portion of the blank into an L shape after the shaft hole finishing step is performed and a hole forming step of forming a hole in a flat portion of the blank without having the shaft hole formed therein by punching after the bending step is performed. The hole is used for attaching the motor vehicle door hinge to one of a vehicle body and a door.

According to a seventh aspect of the present invention, a method for manufacturing a motor vehicle door hinge includes assembling the chassis-side door hinge that is to be attached to a vehicle body and that is manufactured by the method according to the sixth aspect and the door-side door hinge that is to be attached to a door and that is manufactured by the method according to the sixth aspect into a pair of motor vehicle door hinges by inserting a tubular plastic shock-absorbing member into the shaft hole of each of the door hinges, inserting a head hinge pin into the two tubular plastic shock-absorbing members and a washer so that the hinge pin penetrates the tubular plastic shock-absorbing members and the washer, and caulking an end of the head hinge pin.

According to an eighth aspect of the present invention, a method for manufacturing a motor vehicle door hinge by manufacturing a first member from a first steel plate blank having predetermined thickness, width, and height by processes including cold heading and punching, manufacturing a second member having a polygonal plate shape with a size in the height direction larger than the height of the first blank from a second steel plate blank by punching, and integrating the first member with the second member is provided.

The method includes a cold heading step of forming, at one end of the first blank in the width direction, a protrusion attached cylindrical bulging portion having a protrusion attached cylindrical bulging shape that bulges in the thickness direction so as to have a horizontal cross section of a circular shape or an elliptical shape and that extends in the height direction and having a protrusion on the top end of the circular shape or the elliptical shape by cold heading, where the protrusion serves as a door stopper, a shaft hole forming step of forming a shaft hole that passes through the protrusion attached cylindrical bulging portion along the shaft axis using a first punch and a first die, where the shaft hole allows a hinge pin to pass therethrough, a shaft hole finishing step of punching the shaft hole formed in the shaft hole forming step from the end at which machining of the first punch ends using a second punch and a second die so that the first member is manufactured, forming, in the second blank, a quadrilateral hole for receiving an end of the first member opposite to the shaft hole and two holes used for attaching the motor vehicle door hinge to a vehicle body by punching and locating one of the two hole at a horizontal position that is the same as a horizontal position of the quadrilateral hole and the other hole below or above the quadrilateral hole so that the second member is manufactured, and assembling the first member and the second member into a chassis-side door hinge to be attached to the vehicle body by inserting the end of the first member opposite to the shaft hole into the quadrilateral hole of the second member and caulking the end.

The first punch used in the shaft hole forming step has a top end having a shape of a cone with a cone angle in the range from 70° to 120°. A height of the protrusion attached cylindrical bulging portion of the shaft hole formed in the shaft hole forming step is twice or more a diameter of the shaft hole. The first die has an inner wall having a gap relative to an outer circumferential surface of the protrusion attached cylindrical bulging portion of the blank. The size of a gap volume formed by the outer circumferential surface of the protrusion attached cylindrical bulging portion and the inner wall is set so that when the first punch punches the protrusion attached cylindrical bulging portion of the blank, a hole portion formed from an end at which machining of the first punch starts to a predetermined length position does not produce a punched slug and the protrusion attached cylindrical bulging portion bulges outward and a hole portion from the predetermined length position to the end at which the machining of the first punch ends produces a punched slug to be ejected. The second die has a shape substantially the same as the shape of the first die. The second punch has a top end having a shape of a truncated cone or a cone with a cone angle in the range from 70° to 120° and the largest diameter that is larger than that of the first punch by 0.1 mm to 0.3 mm.

According to a ninth aspect of the present invention, in addition to the configuration according to the eighth aspect of the present invention, the method for manufacturing a motor vehicle door hinge further includes forming a stepped portion having a small horizontal cross section at the end of the first member opposite to the shaft hole so as to have a size that is longer than the thickness of the second member by a predetermined value, forming the quadrilateral hole of the second member so that the quadrilateral hole on an insertion side has a shape that mates with the stepped portion of the first member and the quadrilateral hole on the vehicle body side has a taper that flares outward, and integrating the first member with the second member by inserting the stepped portion of the first member into the quadrilateral hole and performing a caulking process so that an end surface of the stepped portion is flush with a surface of the second member on the vehicle body side.

According to a tenth aspect of the present invention, a method for manufacturing a motor vehicle door hinge includes assembling the door-side door hinge that is to be attached to a door and that is manufactured by the method according to the sixth aspect and the chassis-side door hinge that is to be attached to a vehicle body and that is manufactured by the method according to the ninth aspect into a pair of motor vehicle door hinges by inserting a tubular plastic shock-absorbing member into the shaft hole of each of the door hinges, inserting a head hinge pin into the two tubular plastic shock-absorbing members and a washer so that the hinge pin penetrates the tubular plastic shock-absorbing members and the washer, and caulking an end of the head hinge pin.

Advantageous Effects of Invention

According to the first aspect of the present invention, the method for manufacturing a motor vehicle door hinge includes a cold heading step of forming, at one end of the blank in the width direction, a cylindrical bulging portion having a cylindrical bulging shape bulging in the thickness direction so as to have a horizontal cross section of a circular shape or an elliptical shape and extending in the height direction by cold heading, a shaft hole forming step of forming a shaft hole that passes through the cylindrical bulging portion along the shaft axis using a first punch and a first die, where the shaft hole allows a hinge pin to pass therethrough, and a shaft hole finishing step of punching the shaft hole formed in the shaft hole forming step from the end at which machining of the first punch ends using a second punch and a second die. In particular, the first punch used in the shaft hole forming step has a top end having a shape of a cone with a cone angle in the range from 70° to 120°. The first die has an inner wall having a gap relative to an outer circumferential surface of the cylindrical bulging portion of the blank, and the size of a gap volume formed by the outer circumferential surface of the cylindrical bulging portion and the inner wall is set so that when the first punch punches the cylindrical bulging portion of the blank, a hole portion formed from the end at which machining of the first punch starts to a predetermined length position does not produce a punched slug, the cylindrical bulging portion bulges outward, and a hole portion from the predetermined length position to the end at which the machining of the first punch ends produces a punched slug to be ejected. Accordingly, an advantage that the shaft hole having a height that is twice or more the diameter of the shaft hole can be processed by punching is provided. Thus, by performing, for example, cold heading and punching on a steel plate blank, a motor vehicle door hinge having a sufficient strength can be manufactured at low cost.

According to the second aspect of the present invention, the method for manufacturing a motor vehicle door hinge includes a cold heading step of forming, at one end of the blank in the width direction, a protrusion attached cylindrical bulging portion having a protrusion attached cylindrical bulging shape that bulges in the thickness direction so as to have a horizontal cross section of a circular shape or an elliptical shape and that extends in the height direction and having a protrusion on the top end of the circular shape by cold heading, where the protrusion serves as a door stopper, a shaft hole forming step of forming a shaft hole that passes through the cylindrical bulging portion along the shaft axis using a first punch and a first die, where the shaft hole allows a hinge pin to pass therethrough, and a shaft hole finishing step of punching the shaft hole formed in the shaft hole forming step from the end at which machining of the first punch ends using a second punch and a second die. In particular, the first punch used in the shaft hole forming step has a top end having a shape of a cone with a cone angle in the range from 70° to 120°. The first die has an inner wall having a gap relative to an outer circumferential surface of the protrusion attached cylindrical bulging portion of the blank. The size of a gap volume formed by the outer circumferential surface of the protrusion attached cylindrical bulging portion and the inner wall is set so that when the first punch punches the protrusion attached cylindrical bulging portion of the blank, a hole portion formed from an end at which machining of the first punch starts to a predetermined length position does not produce a punched slug and the protrusion attached cylindrical bulging portion bulges outward and a hole portion from the predetermined length position to the end at which the machining of the first punch ends produces a punched slug to be ejected. Accordingly, the shaft hole having a height that is twice or more the diameter of the shaft hole can be processed by punching is provided. Thus, an advantage that by performing, for example, cold heading and punching on a steel plate blank, a motor vehicle door hinge having a sufficient strength can be manufactured at low cost is provided.

According to the third aspect of the present invention, the method for manufacturing a motor vehicle door hinge includes an annealing step of performing one of spheroidizing annealing and soft annealing on the blank after the cold heading step and before the shaft hole forming step. The shaft hole forming step is performed by cold working. Accordingly, an advantage that a shaft hole can be highly accurately formed is provided in addition to the advantage of the first or second aspects of the present invention.

According to the fourth aspect of the present invention, in the shaft hole forming step of the method for manufacturing a motor vehicle door hinge, one of the cylindrical bulging portion and the protrusion attached cylindrical bulging portion is subjected to warm working at a temperature in the range from 450° C. to 900° C. Accordingly, an advantage that the size of the process machinery, such as a press machine, can be reduced is provided in addition to the advantage of the first or second aspects of the present invention. Furthermore, the lifetime of the tool can be increased.

According to the fifth aspect of the present invention, the method for manufacturing a motor vehicle door hinge further includes a wall thickness increasing step of sandwiching one of the cylindrical bulging portion and the protrusion attached cylindrical bulging portion formed at one end of the blank by a split mold die having a back clearance that allows the middle portion of the blank to bulge in the thickness direction so that the other end protrudes from the split mold die and increasing a wall thickness of the middle portion of the blank by pressing the other end of the blank using a punch and a bending step of bending a thick-wall portion of the blank formed in the wall thickness increasing step into an L shape using press working. The shaft hole forming step and the shaft hole finishing step are performed after the wall thickness increasing step is performed. After the shaft hole finishing step is performed, the bending step of bending the thick-wall portion of the blank formed in the wall thickness increasing step into an L shape by press working is performed. Accordingly, since the bending portion is formed as a thick-wall portion in the wall thickness increasing step, an advantage that the strength of the bending portion can be increased is provided in addition to the advantage of any one of the first to fourth aspects of the present invention.

According to the sixth aspect of the present invention, the method for manufacturing a motor vehicle door hinge further include a bending step of bending the middle portion of the blank into an L shape after the shaft hole finishing step is performed and a hole forming step of forming a hole in a flat portion of the blank without having the shaft hole formed therein by punching after the bending step is performed. The hole is used for attaching the motor vehicle door hinge to one of a vehicle body and a door. Accordingly, an advantage that a bending portion and a hole can be efficiently formed is provided in addition to the advantage of any one of the first to fifth aspects of the present invention.

According to the seventh aspect of the present invention, the method for manufacturing a motor vehicle door hinge includes assembling the chassis-side door hinge that is to be attached to a vehicle body and that is manufactured by the method according to the sixth aspect and the door-side door hinge that is to be attached to a door and that is manufactured by the method according to the sixth aspect into a pair of motor vehicle door hinges by inserting a tubular plastic shock-absorbing member into the shaft hole of each of the door hinges, inserting a head hinge pin into the two tubular plastic shock-absorbing members and a washer so that the hinge pin penetrates the tubular plastic shock-absorbing members and the washer, and caulking an end of the head hinge pin. Accordingly, an advantage that a pair of motor vehicle door hinges can be simply manufactured is provided in addition to the advantage of the sixth aspect of the present invention.

According to the eighth aspect of the present invention, the method for manufacturing a motor vehicle door hinge by manufacturing a first member from a first steel plate blank having predetermined thickness, width, and height by processes including cold heading and punching, manufacturing a second member having a polygonal plate shape with a size in the height direction larger than the height of the first blank from a second steel plate blank by punching, and integrating the first member with the second member is provided. The method includes a cold heading step of forming, at one end of the first blank in the width direction, a protrusion attached cylindrical bulging portion having a protrusion attached cylindrical bulging shape that bulges in the thickness direction so as to have a horizontal cross section of a circular shape or an elliptical shape and that extends in the height direction and having a protrusion on the top end of the circular shape or the elliptical shape by cold heading, where the protrusion serves as a door stopper, a shaft hole forming step of forming a shaft hole that passes through the protrusion attached cylindrical bulging portion along the shaft axis using a first punch and a first die, where the shaft hole allows a hinge pin to pass therethrough, a shaft hole finishing step of punching the shaft hole formed in the shaft hole forming step from the end at which machining of the first punch ends using a second punch and a second die. In this way, the first member is manufactured. In particular, the first punch used in the shaft hole forming step has a top end having a shape of a cone with a cone angle in the range from 70° to 120°. The first die has an inner wall having a gap relative to an outer circumferential surface of the protrusion attached cylindrical bulging portion of the blank. The size of a gap volume formed by the outer circumferential surface of the protrusion attached cylindrical bulging portion and the inner wall is set so that when the first punch punches the protrusion attached cylindrical bulging portion of the blank, a hole portion formed from an end at which machining of the first punch starts to a predetermined length position does not produce a punched slug and the protrusion attached cylindrical bulging portion bulges outward and a hole portion from the predetermined length position to the end at which the machining of the first punch ends produces a punched slug to be ejected. Furthermore, in the second blank, a quadrilateral hole for receiving an end of the first member opposite to the shaft hole and two holes used for attaching the motor vehicle door hinge to a vehicle body are formed by punching. One of the two holes is disposed at a horizontal position that is the same as a horizontal position of the quadrilateral hole, and the other hole is disposed below or above the quadrilateral hole. In this way, the second member is manufactured. Thereafter, the first member and the second member are assembled into a chassis-side door hinge to be attached to the vehicle body by inserting the end of the first member opposite to the shaft hole into the quadrilateral hole of the second member and caulking the end. Accordingly, even when an attaching portion of the vehicle body is narrow in the horizontal direction, the second unit can be integrated with the first member by caulking. Therefore, an advantage that the chassis-side door hinge having a complicated structure can be manufactured at low cost is provided.

According to the ninth aspect of the present invention, the method for manufacturing a motor vehicle door hinge further includes forming a stepped portion having a small horizontal cross section at the end of the first member opposite to the shaft hole so as to have a size that is longer than the thickness of the second member by a predetermined value, forming the quadrilateral hole of the second member so that the quadrilateral hole on an insertion side has a shape that mates with the stepped portion of the first member and the quadrilateral hole on the vehicle body side has a taper that flares outward, and integrating the first member with the second member by inserting the stepped portion of the first member into the quadrilateral hole and performing a caulking process so that an end surface of the stepped portion is flush with a surface of the second member on the vehicle body side. Accordingly, an advantage that the first member and the second member can be firmly integrated into one body is provided in addition to the advantage of the eighth aspect of the present invention.

According to the tenth aspect of the present invention, the method for manufacturing a motor vehicle door hinge includes assembling the door-side door hinge that is to be attached to a door and that is manufactured by the method according to the sixth aspect and the chassis-side door hinge that is to be attached to a vehicle body and that is manufactured by the method according to the ninth aspect into a pair of motor vehicle door hinges by inserting a tubular plastic shock-absorbing member into the shaft hole of each of the door hinges, inserting a head hinge pin into the two tubular plastic shock-absorbing members and a washer so that the hinge pin penetrates the tubular plastic shock-absorbing members and the washer, and caulking an end of the head hinge pin. Accordingly, an advantage that a pair of motor vehicle door hinges can be simply manufactured is provided in addition to the advantages of the sixth and ninth aspects of the present invention.

DESCRIPTION OF EMBODIMENTS

Figure 1:
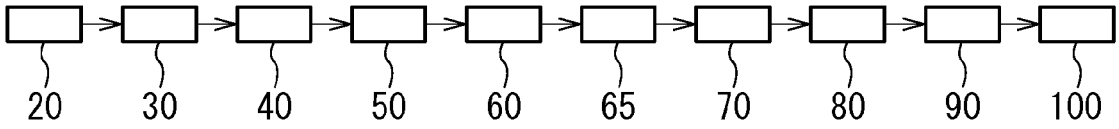
FIG. 1 is a block diagram according to a first embodiment of the present invention.

Embodiments of the present invention are described in detail below with reference to the accompanying drawings.

A method for manufacturing a motor vehicle door hinge according to a first embodiment of the present invention is described next with reference to FIGS. 1 to 17.

The processes of the method for manufacturing a motor vehicle door hinge according to a first embodiment is schematically described with reference to a block diagram illustrated in FIG. 1 first.

The processes of the method for manufacturing a motor vehicle door hinge according to a first embodiment include a planarization cutting process 20, a cold heading process 30, a wall thickness increasing process 40, a thin-wall forming process 50, a shape reforming process 60, an annealing process 65, a shaft hole forming process 70, a shaft hole finishing process 80, a bending process 90, and a hole forming process 100.

Figure 2:
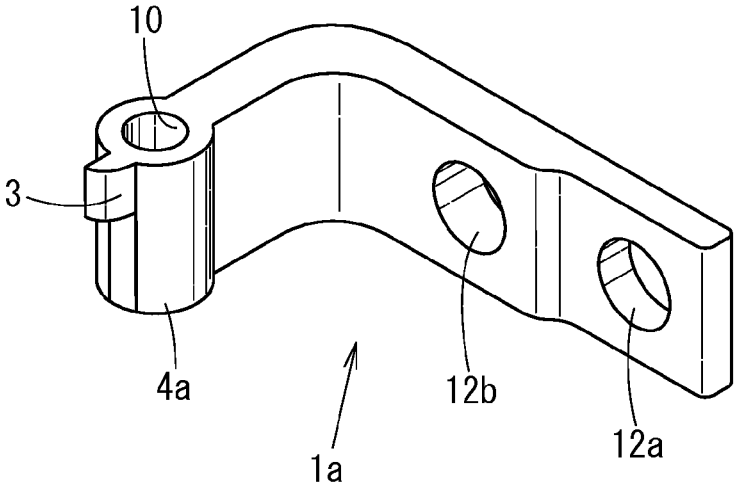
FIG. 2 is a perspective view of a chassis-side door hinge according to the first embodiment of the present invention.

As illustrated in FIG. 2, a motor vehicle door hinge 1*a* is a chassis-side door hinge 1*a* attached to a vehicle body and produced using the manufacturing method according to the first embodiment. In FIG. 2, the reference numeral "3" represents a protrusion portion, the reference numeral "4*a*" represents a protrusion attached tubular bulging portion, the reference numeral "10" represents a shaft hole, and the reference numerals "12*a*" and "12*b*" represent mounting holes.

The above-described processes 20 to 100 for producing the chassis-side door hinge 1*a* are described below with reference to FIGS. 3 to 17.

Figure 3A:
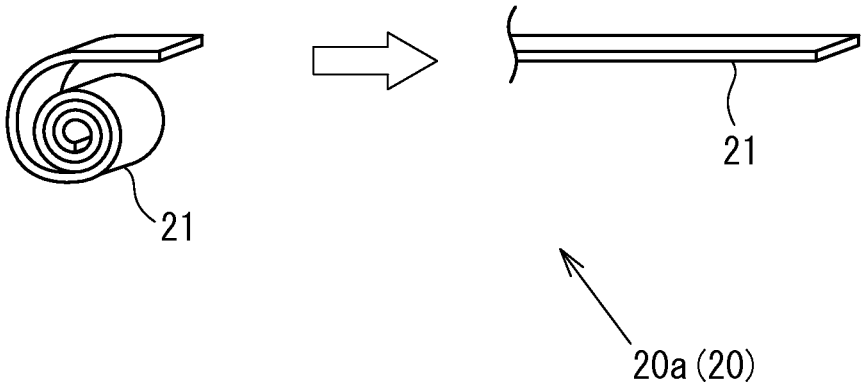
FIG. 3 illustrates a planarization cutting process according to the first embodiment of the present invention, where FIG. 3(*a*) illustrates a planarization process, and FIG. 3(*b*) illustrates a cutting process.
Figure 3B:
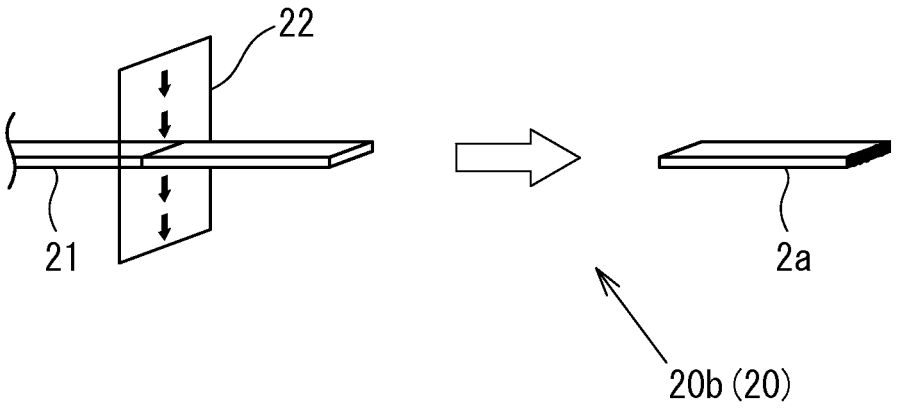

As illustrated in FIGS. 3(*a*) and 3(*b*), in a planarization process 20*a* of the planarization cutting process 20 illustrated in FIG. 3(*a*), an SS400 steel coil stock 21 having a thickness of 9 mm and a height of 25 mm, which extends in the up and down direction when a steel plate is used as a door hinge, is planarized by a feed roll (not illustrated). In a cutting process 20*b* illustrated in FIG. 3(*b*), the steel coil stock 21 is cut into pieces each having a width of 135 mm by a cutting machine 22. In this way, a steel blank 2*a* having a thickness of 9 mm, a width of 135 mm, and height of 25 mm is formed.

Figures 4A, 4B, 4C, 4D, 4E, 4F, 4G, 4H, 4I:
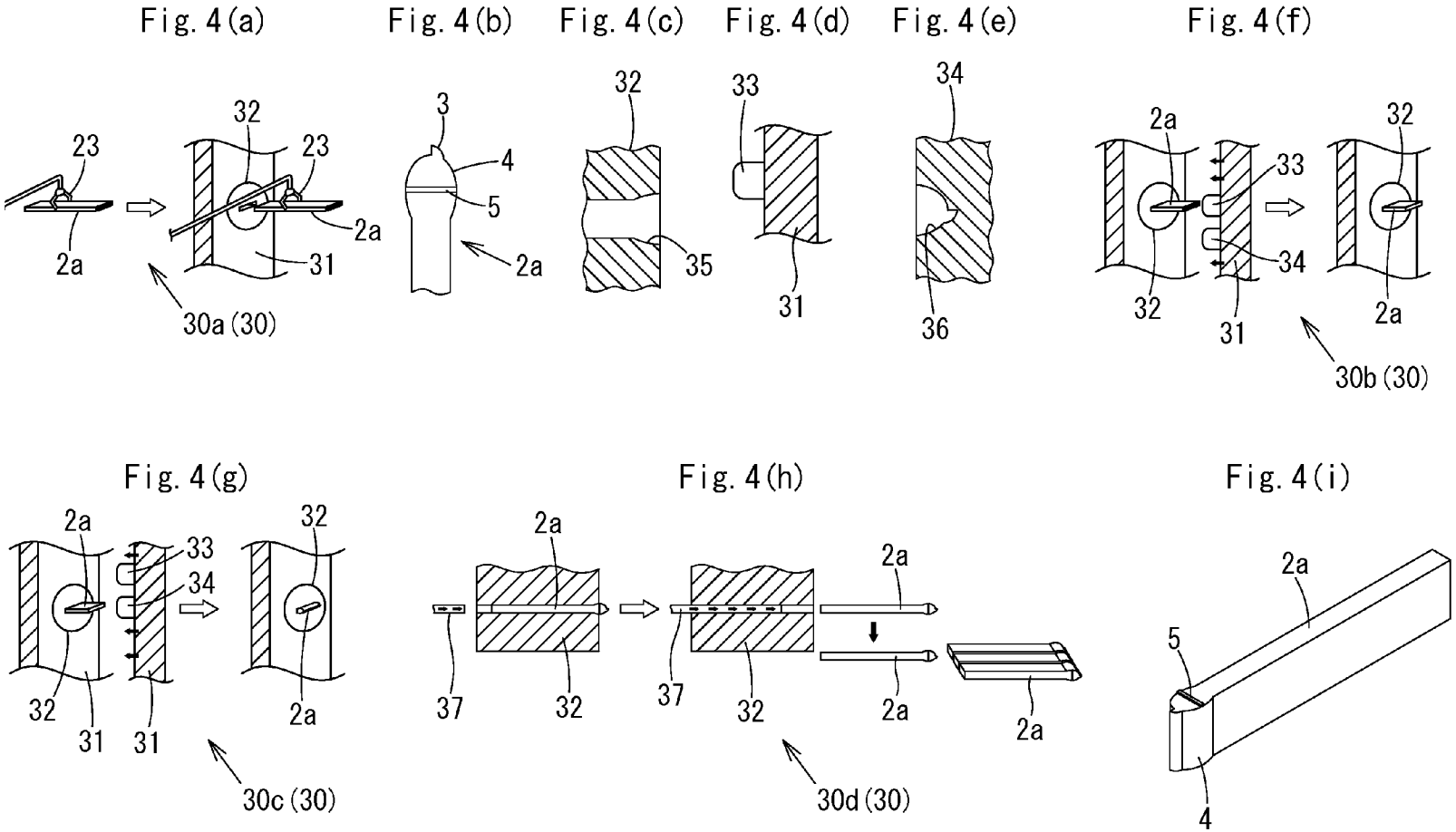
FIG. 4 illustrates a cold heading process according to the first embodiment of the present invention, where FIG. 4(*a*) illustrates a preparation process, FIG. 4(*b*) is a plan view of a protrusion attached cylindrical bulging portion, FIG. 4(*c*) is a cross-sectional view of a cold heading die, FIG. 4(*d*) illustrates a flat punch, FIG. 4(*e*) is a cross-sectional view of a cold heading punch, FIG. 4(*f*) illustrates a first process, FIG. 4(*g*) illustrates a second process, FIG. 4(*h*) illustrates a third process, and FIG. 4(*i*) illustrates a blank subjected to a cold heading process.

Subsequently, as illustrated in FIG. 4(*a*), in a preparation process 30*a* of the cold heading process 30 illustrated in FIGS. 4(*a*), 4(*b*), 4(*c*), 4(*d*), 4(*e*), 4(*f*), 4(*g*), and 4(*h*), the blank 2*a* formed in the planarization cutting process 20 is pinched by a transport claw 23 and is transported to a position in front of a cold heading die 32 of a double header machine 31 having the cold heading process 30.

The double header machine 31 causes one end of the steel blank 2*a* in the width direction to bulge outward. As illustrated in a plan view of FIG. 4(*b*), through a cold heading process, the end of the steel blank 2*a* bulges outward in the thickness direction so as to have a horizontal cross section of an ellipse with a minor axis of 13 mm and a major axis of 16 mm. In addition, the double header machine 31 causes the top end of the ellipse in the major axis direction to bulge outward to form the protrusion portion 3. The protrusion portion 3 serves as a vehicle door stopper. In this manner, a protrusion attached cylindrical bulging portion 4 having a cylindrical bulging shape with a protrusion extending in the height direction is formed. Note that in FIG. 4(*b*), the reference numeral "5" represents a burr (described in more detail below).

The double header machine 31 includes the cold heading die 32 illustrated in FIG. 4(*c*), a flat punch 33 having a flat and smooth punch surface illustrated in FIG. 4(*d*), and a cold heading punch 34 illustrated in FIG. 4(*e*). As indicated by the cross sections illustrated in FIGS. 4(*c*) and 4(*e*), the cold heading die 32 and the cold heading punch 34 have recesses 35 and 36 for forming the protrusion attached cylindrical bulging portion 4 on the facing surfaces, respectively.

In a first process 30*b* of the cold heading process 30 performed by the double header machine 31, as illustrated in FIG. 4(*f*), a cutting surface of the blank 2*a* is fixed to the cold heading die 32 so as to protrude from the cold heading die 32, and is pressed by the flat punch 33. Thus, a shear droop and a roughness of the cutting surface of the blank 2*a* are reformed.

Subsequently, in a second process 30*c* of the cold heading process 30 performed by the double header machine 31, as illustrated in FIG. 4(*g*), the protrusion attached cylindrical bulging portion 4 is formed by cold heading using the cold heading punch 34 and the cold heading die 32.

Thereafter, in a third process 30*d* of the cold heading process 30, as illustrated in FIG. 4(*h*), the blank 2*a* having the protrusion attached cylindrical bulging portion 4 formed therein is kicked out of the cold heading die 32 by a knock-out pin 37. Thus, the cold heading process 30 is completed.

The cold heading punch 34 applies a pressing force to the cutting surface of the blank 2*a* such that the cold heading punch 34 is not brought into contact with the cold heading die 32 and performs a cold heading process. As indicated by a perspective view of FIG. 4(*i*), the blank 2*a* formed by the cold heading process 30 has the burr 5 on the end surface of the protrusion attached cylindrical bulging portion 4 in the height direction. The burr 5 is generated so as to extend in a small gap formed between the cold heading punch 34 and the cold heading die 32.

Note that since the circumferential direction of the protrusion attached cylindrical bulging portion 4 is the bulging direction of the protrusion portion attached cylindrical bulging portion 4, a burr is negligibly formed.

Subsequently, the wall thickness increasing process 40, the thin-wall forming process 50, the shape reforming process 60, the shaft hole forming process 70, the shaft hole finishing process 80, the bending process 90, and the hole forming process 100 are performed using a 500-ton transfer press machine.

Figure 5:
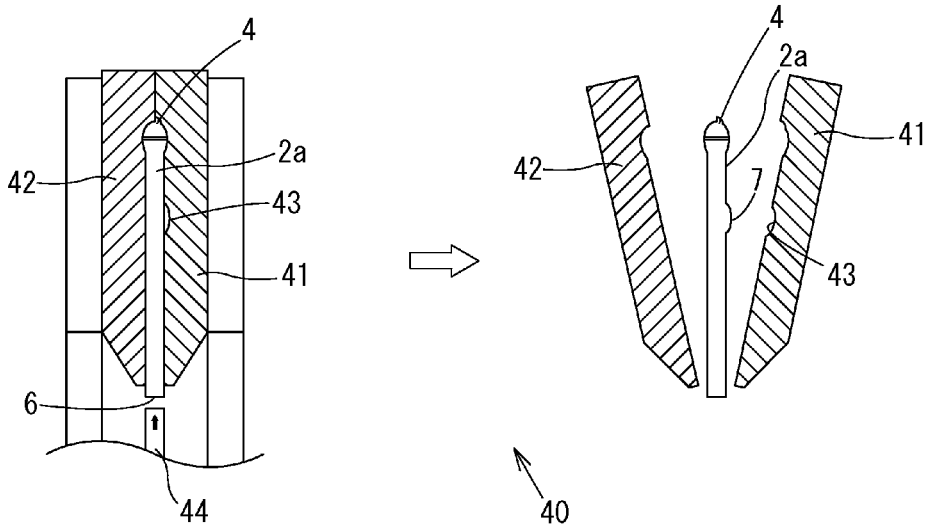
FIG. 5 is a diagram for illustrating a wall thickness increasing process according to the first embodiment of the present invention.

As illustrated in FIG. 5, in the wall thickness increasing process 40, the protrusion attached cylindrical bulging portion 4 is sandwiched by split mold dice 41 and 42 having a mating surface in the middle of the blank 2*a* in the thickness direction. Thus, the other end 6 of the blank 2*a* protrudes from the split mold dice 41 and 42. In addition, the split mold die 41 has a back clearance 43 that allows the middle portion of the blank 2*a* to bulge thereinto in the thickness direction. By pressing the other end 6 of the blank 2*a* using a thick-wall forming punch 44, the wall thickness of the middle portion of the blank 2*a* can be increased.

Through the wall thickness increasing process 40, a thick-wall portion 7 is formed in the middle of the blank 2*a*. Subsequently, in the bending process 90 (described in more detail below), the thick-wall portion 7 is bent into an L shape.

Figure 6A:
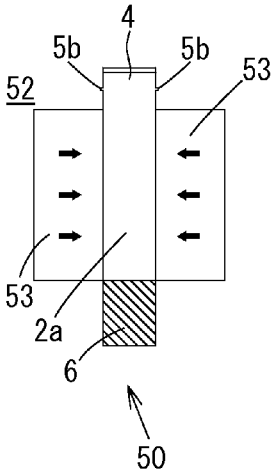
FIG. 6 is a diagram for illustrating a thin-wall forming process according to the first embodiment of the present invention, where FIG. 6(*a*) is a plan view and FIG. 6(*b*) is a side view.
Figure 6B:
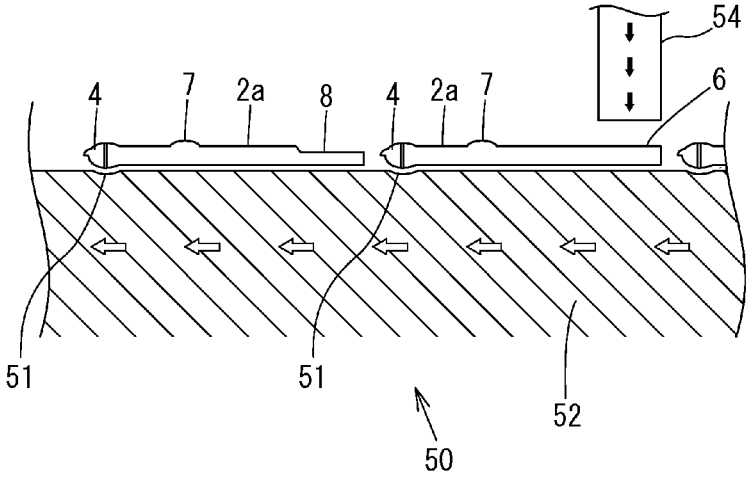

Thereafter, in the thin-wall forming process 50 illustrated in FIGS. 6(*a*) and 6(*b*), the middle portion of the blank 2*a* is pinched by a fixing tool 53 and is fixed on a thin-wall forming die 52 having a recess portion 51. The recess portion 51 horizontally receives the protrusion attached cylindrical bulging portion 4 of the blank 2*a* having the thick-wall portion 7 formed therein through the wall thickness increasing process 40. The thickness of the other end 6 of the blank 2*a* is reduced from 9 mm to 5.5 mm using a thin-wall forming punch 54. In this manner, a thin wall portion 8 is formed.

Figure 7:
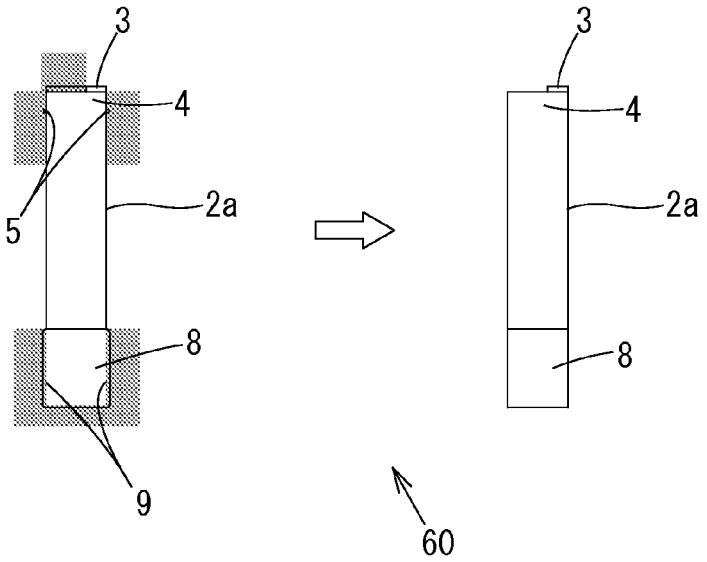
FIG. 7 is a diagram for illustrating a shape reforming process according to the first embodiment of the present invention.

In the shape reforming process 60 illustrated in FIG. 7, as in FIG. 6(*a*), the middle portion of the blank 2*a* is pinched by a fixing tool and is fixed. Thereafter, ⅔ of the protrusion portion 3 of the protrusion attached cylindrical bulging portion 4 in the height direction (the right-left direction in the drawing), the burr 5 generated in the cold heading process 30, and a excess thickness 9 of the thin wall portion 8 formed in the thin-wall forming process 50 are cut off by a shape reforming punch (not illustrated).

Before forming a shaft hole 10 that allows a hinge pin to be inserted thereinto along the center axis of the shaft hole 10 in the shaft hole forming process 70, the annealing process 65 (refer to FIG. 1) is performed. Since work hardening occurs in the protrusion attached cylindrical bulging portion 4 of the blank 2*a* in the cold heading process 30, the work hardening needs to be removed in order to facilitate formation of the shaft hole 10. Thus, in the annealing process 65, spheroidizing annealing is performed.

To perform the annealing process 65, a plurality of the blanks 2*a* subjected to the shape reforming process 60 are temporarily reserved. If the number of the stored blanks 2*a* reaches a predetermined value, the blanks 2*a* are put into a furnace and kept at an annealing temperature immediately above the transformation point. Thereafter, the blanks 2*a* are slowly-cooled in the furnace.

Figure 8:
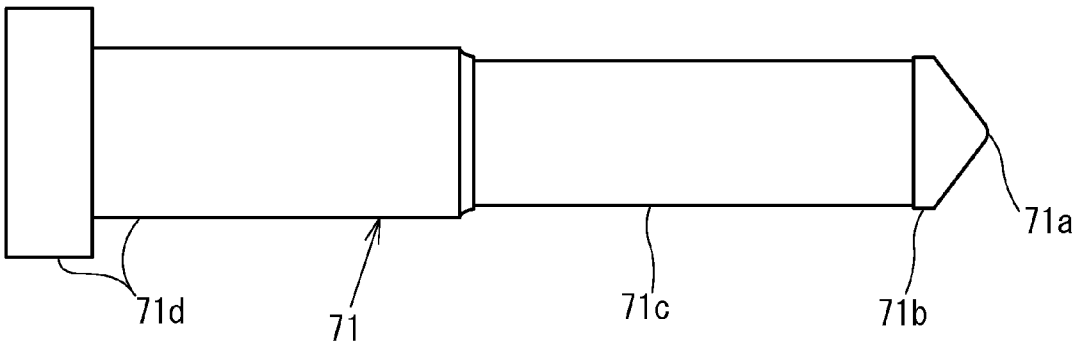
FIG. 8 is a front view of a first punch according to the first embodiment of the present invention.
Figure 9:
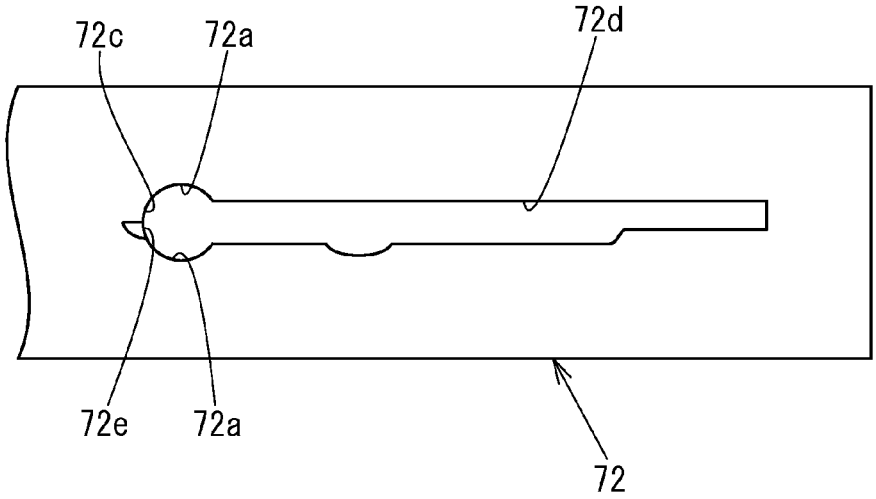
FIG. 9 is a plan view of a first die according to the first embodiment of the present invention.
Figure 10:
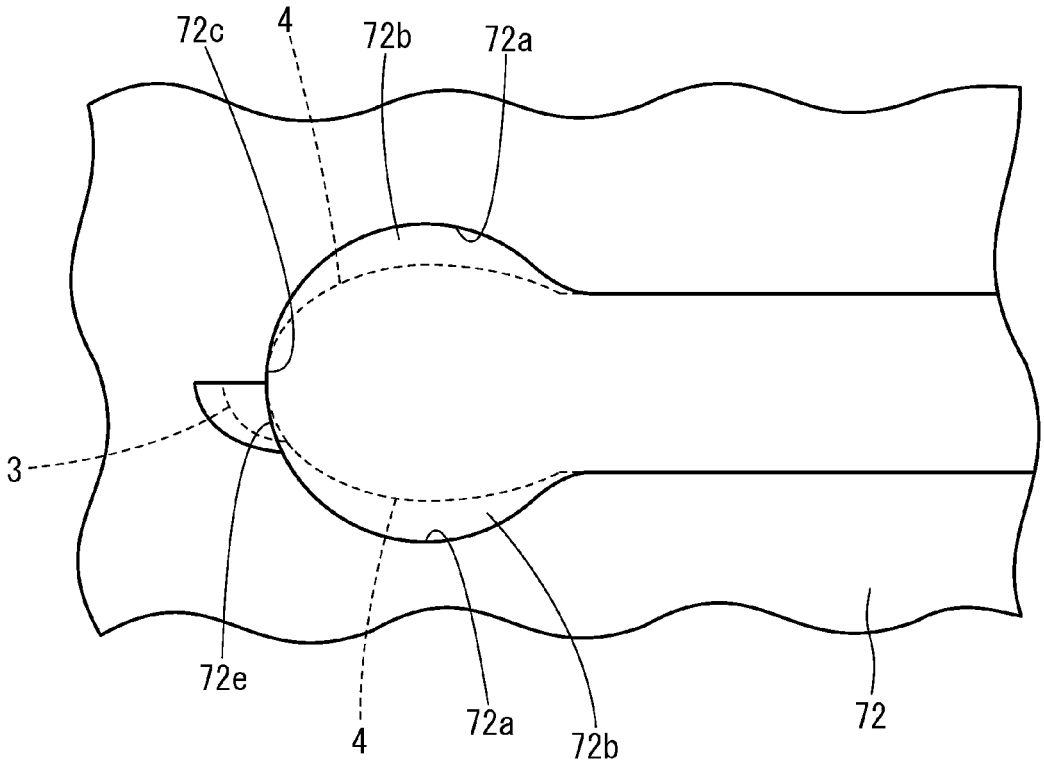
FIG. 10 is a partial enlarged plan view of a protrusion attached cylindrical bulging portion and a first die according to the first embodiment of the present invention.
Figure 11:
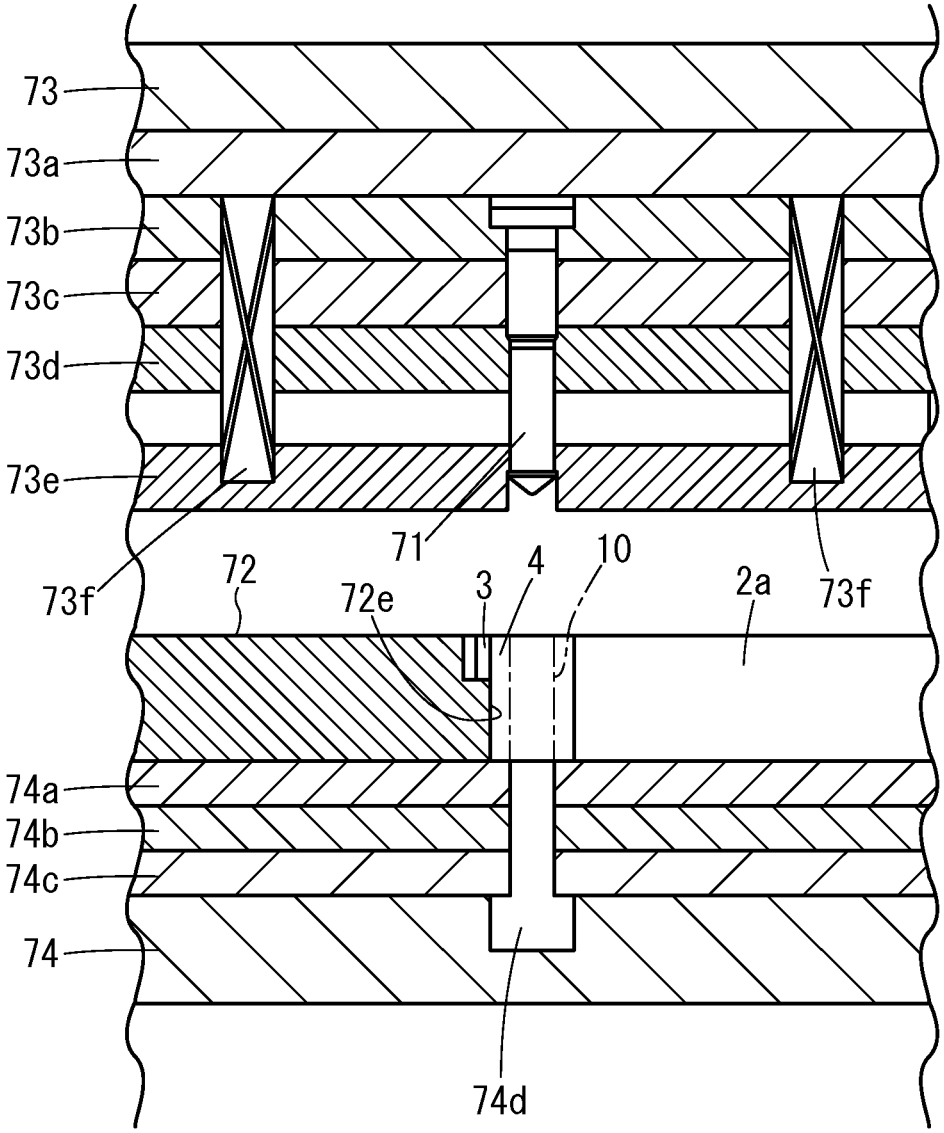
FIG. 11 is a cross-sectional view of an upper and lower die set according to the first embodiment of the present invention.

The shaft hole forming process 70 is described next with reference to FIGS. 8 to 11. FIG. 8 is a plan view of a first punch. FIG. 9 is a plan view of a first die. FIG. 10 is an enlarged plan view of the protrusion attached cylindrical bulging portion 4 of the blank 2*a* and a first die 8. FIG. 11 is a cross-sectional view of an upper and lower die set.

In the shaft hole forming process 70, the shaft hole 10 is formed using a first punch 71 and a first die 72 so as to allow a hinge pin to pass therethrough along the center axis of the protrusion attached cylindrical bulging portion 4 of the blank 2*a* subjected to the annealing process 65.

The first punch 71 illustrated in FIG. 8 includes a cylinder portion 71*b* having a circular cone at the top end thereof, a shaft portion 71*c*, and a fixing portion 71*d*. The circular cone has a cone angle of 90°. The circular cone has a roundness 71*a* with a radius of 1 mm at the top end thereof. The largest diameter of the circular cone and the cylinder portion 71*b* is 8.6 mm. The length of the cylinder portion 71*b* is 1 mm. The diameter of the shaft portion 71*c* is smaller than the diameter of the cylinder portion 71*b* by 0.2 mm.

In addition, as illustrated in FIG. 10, the first die 72 illustrated in FIG. 9 has an inner wall 72*a* that is apart from the outer circumferential surface of the protrusion attached cylindrical bulging portion 4 of the blank 2*a* (indicated by a dotted line). A gap volume 72*b* is formed between the outer circumferential surface of the protrusion attached cylindrical bulging portion 4 and the inner wall 72*a*. The size of the gap volume 72*b* is set so that when the protrusion attached cylindrical bulging portion 4 of the blank 2*a* is punched by the first punch 71, a hole portion formed from the end at which machining of the first punch 71 starts to ⅘ the length of the protrusion attached cylindrical bulging portion 4 does not produce a punched slug and bulges outward, and a hole portion from ⅘ the length of the protrusion attached cylindrical bulging portion 4 to the end at which the machining of the first punch 71 ends is ejected as a punched slug.

In addition, the first die 72 has a positioning portion 72*c* formed therein. The top end of the protrusion attached cylindrical bulging portion 4 of the blank 2*a* is brought into contact with the positioning portion 72*c*. Thus, the outer circumferential surface of the blank 2*a* is inserted into an inner wall 72*d* other than a portion that the protrusion attached cylindrical bulging portion 4 faces without any gap therebetween.

Note that FIG. 10 is a partial enlarged view of the first die 72 before the protrusion attached cylindrical bulging portion 4 is inserted into the first die 72 and is punched by the first punch 71. The protrusion portion 3 of the protrusion attached cylindrical bulging portion 4 occupies ⅓ the length of the protrusion attached cylindrical bulging portion 4 in the height direction after the shape reforming process 60 is performed. Accordingly, the lower ⅔ the length of the first die 72 in the height direction, which corresponds to the shape of the protrusion portion 3, has an inner wall 72*e* having an inner diameter of 16 mm without any gap between the inner wall 72*e* and the protrusion portion, as shown in FIGS. 10 and 11.

By using the first punch 71, the first die 72, and the 500-ton transfer press machine, the shaft hole 10 is formed along the shaft axis of the protrusion attached cylindrical bulging portion 4.

As illustrated in FIG. 11, in the shaft hole formation, the first punch 71 is attached to an upper die set 73 of the transfer press machine that moves up and down using, for example, a punch plate 73*a*, punch folders 73*b*, 73*c*, and 73*d*, a stripper 73*e*, and a spring 73*f*. In addition, the first die 72 is fixed to a lower die set 74 fixed to the transfer press machine using a die folder 74*a* and die plates 74*b* and 74*c*.

Thereafter, the blank 2*a* is inserted into the first die 72. The upper die set 73 is lowered so that the stripper 73*e* of the upper die set 73 is brought into contact with the first die 72. Thereafter, the blank 2*a* except for a portion of the shaft hole 10 formed in the blank 2*a* is fixed between the stripper 73*e* and the die folder 74*a* in the up and down direction by the spring 73*f*. Thereafter, the first punch 71 is lowered. Thus, the shaft hole 10 is formed. At that time, a hole portion formed from the end at which machining of the first punch 71 starts to ⅘ the length of the blank 2*a* does not produce a punched slug and the protrusion attached cylindrical bulging portion 4 bulges outward and, thus, the gap volume 72*b* of the first die 72 is filled with the bulging portion. Thereafter, the hole portion formed from ⅘ the length of the blank 2*a* to the end at which the machining of the first punch 71 ends produces a punched slug, and the slug is ejected to the outside through a slug ejection port 74*d*.

Subsequently, the upper die set 73 is raised to the original position, and the blank 2*a* having the shaft hole 10 formed therein is pushed upward out of the first die 72 by a hydraulic power unit (not illustrated). In this way, the shaft hole forming process 70 is completed.

The blank 2*a* subjected to the shaft hole forming process 70 in this manner has a protrusion attached tubular bulging portion 4*a* transformed from the protrusion attached cylindrical bulging portion 4 prior to the shaft hole forming process 70.

The blank 2*a* subjected to the shaft hole forming process 70 is upset by the transfer press machine, and the shaft hole 10 formed in the protrusion attached tubular bulging portion 4*a* is finished in the shaft hole finishing process 80.

Figure 12:
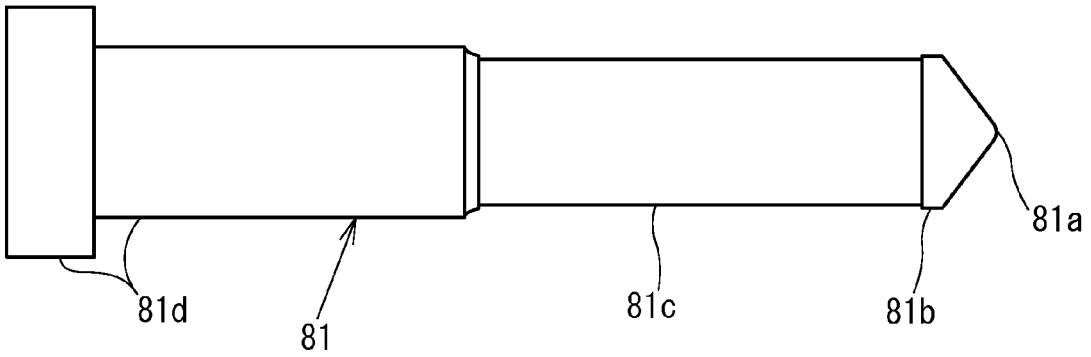
FIG. 12 is a front view of a second punch according to the first embodiment of the present invention.
Figure 13:
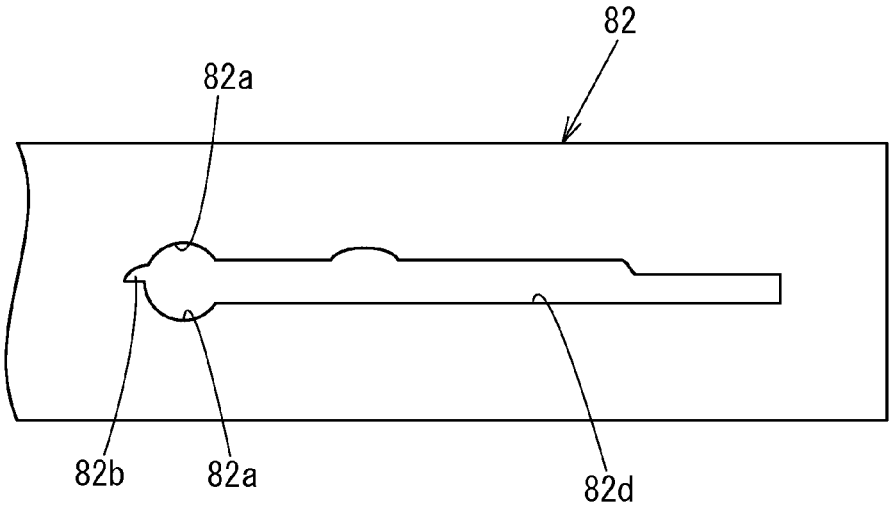
FIG. 13 is a plan view of a second die according to the first embodiment of the present invention.
Figure 14:
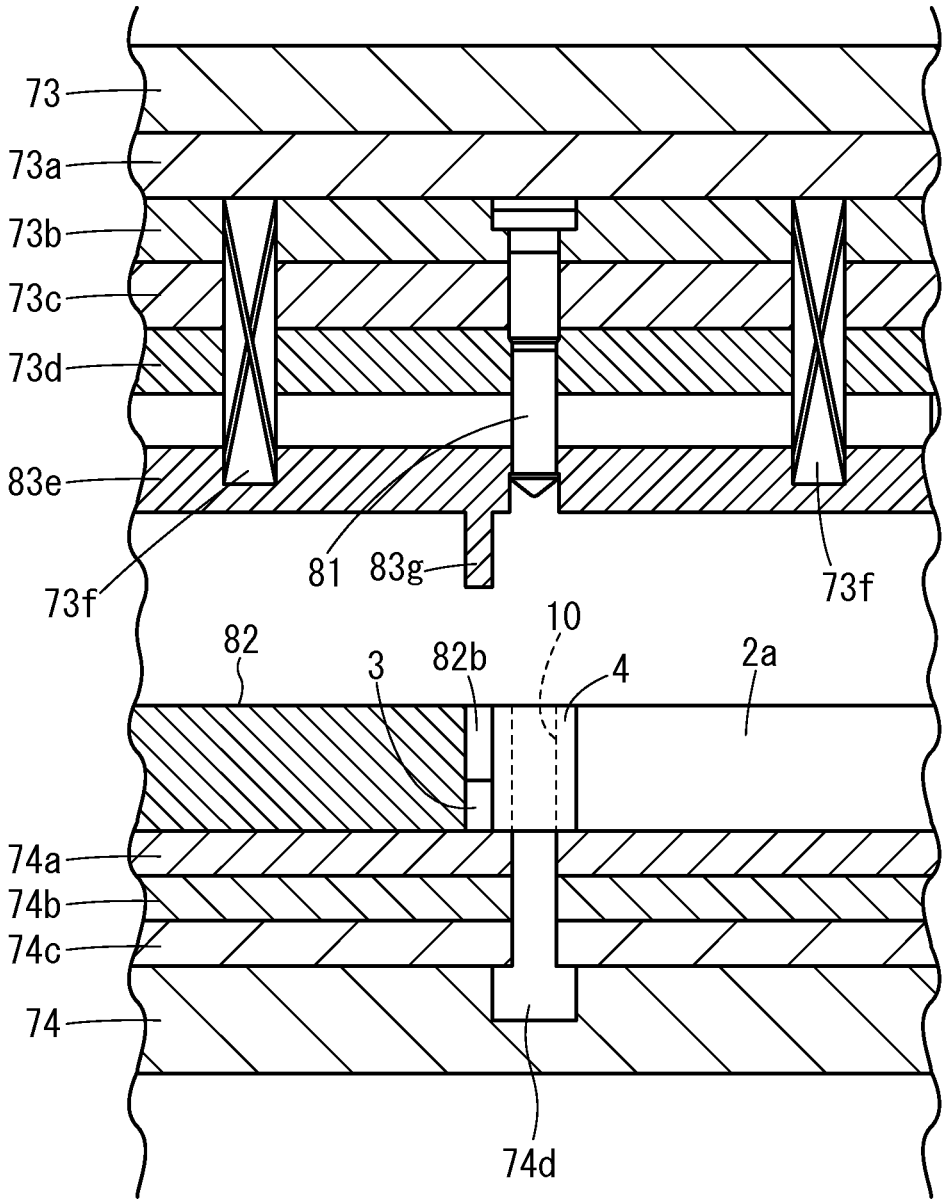
FIG. 14 is a cross-sectional view of an upper and lower die set used in a shaft hole finishing process according to the first embodiment of the present invention.

As illustrated in FIGS. 12 to 14, in the shaft hole finishing process 80, the shaft hole 10 formed in the protrusion attached tubular bulging portion 4*a* of the blank 2*a* through the shaft hole forming process 70 is accurately finished using a second punch 81 and a second die 82.

The second punch 81 illustrated in FIG. 12 includes a cylinder portion 81*b* having a circular cone at the top end thereof, a shaft portion 81*c* and a fixing portion 81*d*. The circular cone has a cone angle of 90°. The circular cone has a roundness 81*a* with a radius of 1 mm at the top end thereof. The largest diameter of the circular cone and the cylinder portion 81*b* is 8.8 mm. The length of the cylinder portion 81*b* is 1 mm. The diameter of the shaft portion 81*c* is smaller than the diameter of the cylinder portion 81*b* by 0.2 mm. The second punch 81 differs from the first punch 71 in that the largest diameter and the diameters of the cylinder portion 81*b* and the shaft portion 81*c* are larger than the largest diameter of the first punch 71 and the diameters of the cylinder portion 71*b* and the shaft portion 71*c* by 0.2 mm. In this way, the shaft hole is finished.

In addition, as illustrated in FIG. 13, a portion of the second die 82 other than the inner wall 72*e* located under the protrusion portion 3 of the first die 72 has a shape that is the same as the shape of the inner wall of the first die 72. The second die 82 has an inner wall 82*a* that matches the outer circumferential surface of the bulging protrusion attached tubular bulging portion 4*a* of the blank 2*a* so that the outer circumferential surface of the blank 2*a* is inserted into an inner wall 82*d* without forming any gap between the outer circumferential surface of the blank 2*a* and a portion of the inner wall 82*d* other than the upper portion of the protrusion portion 3 of the protrusion attached tubular bulging portion 4*a*.

Note that since the blank 2*a* is upset and is inserted into the first die 72 and the second die 82, the first die 72 and the second die 82 in FIGS. 9 and 13 are disposed symmetrically in the up and down direction.

Note that the protrusion portion 3 is formed so as to occupy ⅓ the height of the blank 2*a* from the top. However, since the blank 2*a* is upset and is inserted into the second die 82, a depression 82*b* that allows the outer circumferential surface of the other ⅔ of the blank 2*a* that does not have the protrusion portion 3 of the material 2*a* to be inserted thereinto needs to be formed in the second die 82. Thus, the depression 82*b* is formed throughout the second die 82 in the up and down direction.

Thereafter, in the shaft hole finishing process 80, as illustrated in FIG. 14, the second punch 81 is attached to the upper die set 73 of the transfer press machine that is also used in the shaft hole forming process 70, and the second die 82 is fixed to the lower die set 74. At that time, the upper die set 73 used in the shaft hole finishing process 80 differs from the upper die set 73 used in the shaft hole forming process 70 in that a stripper 83*e* has a lower protrusion 83*g* that mates with the depression 82*b* having a height that is ⅔ the height of the blank 2*a* where the blank 2*a* does not have the protrusion portion 3 attached thereto.

Figure 15:
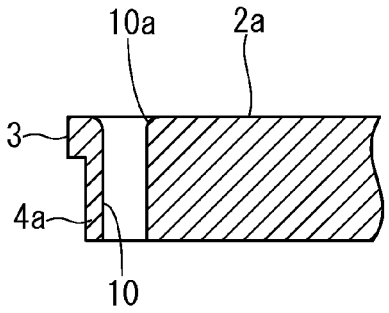
FIG. 15 is a cross-sectional view of a shear droop portion according to the first embodiment of the present invention.

In addition, in the shaft hole finishing process 80, the largest diameter of the second punch 81 is larger than that of the first punch 71 used in the shaft hole forming process 70 by 0.2 mm. However, the blank 2*a* cannot bulge outward due to the presence of the stripper 83*e* and the die folder 74*a* in the up and down direction and the second die 82 in the outer circumferential direction. Accordingly, although in the shaft hole finishing process 80, the shaft hole 10 is increased by only 0.2 mm, the excess thickness is not made into a punched slug. Instead, as illustrated in FIG. 15, a shear droop 10*a* is produced at the end at which machining of the shaft hole forming process 70 starts. The excess thickness fills in the shear droop 10*a*, or the excess thickness is absorbed in fine gaps formed between the protrusion attached tubular bulging portion 4*a* and the inner wall 82*a* of the second die 82.

Thereafter, by using the second punch 81, the second die 82, and a 500-ton transfer press machine, the shaft hole 10 that has a diameter of about 8.8 mm and that is formed in the protrusion attached tubular bulging portion 4*a* is finished into the shaft hole 10 that has a diameter of 9.0 mm.

The shaft hole finishing process is described with reference to FIG. 14. In the description, the same numbering is used for the structures of the shaft hole forming process 70. The second punch 81 is attached to the upper die set 73 of the transfer press machine that moves in the up and down direction using, for example, the punch plate 73*a*, the punch folders 73*b*, 73*c*, and 73*d*, the stripper 83*e*, and the spring 73*f*. In addition, the second die 82 is fixed to the lower die set 74 fixed to the transfer press machine using, for example, the die folder 74*a* and the die plates 74*b* and 74*c*.

Thereafter, the blank 2*a* is upset and is inserted into the second die 82. The upper die set 73 is lowered. The stripper 83*e* of the upper die set 73 is brought into contact with the second die 82 so that the protrusion 83*g* of the stripper 83*e* mates with the depression 82*b* of the second die 82. Subsequently, the blank 2*a* other than a portion of the shaft hole 10 formed in the blank 2*a* is fixed between the stripper 83*e* and the die folder 74*a* in the up and down direction by the spring 73*f*. Thereafter, the second punch 81 is lowered. Thus, the shaft hole 10 is finished.

Subsequently, the upper die set 73 is raised to the original position, and the blank 2*a* having the finished shaft hole 10 formed therein is pushed upward out of the second die 82 by a hydraulic power unit (not illustrated). In this way, the shaft hole finishing process 80 is completed.

Figure 16:
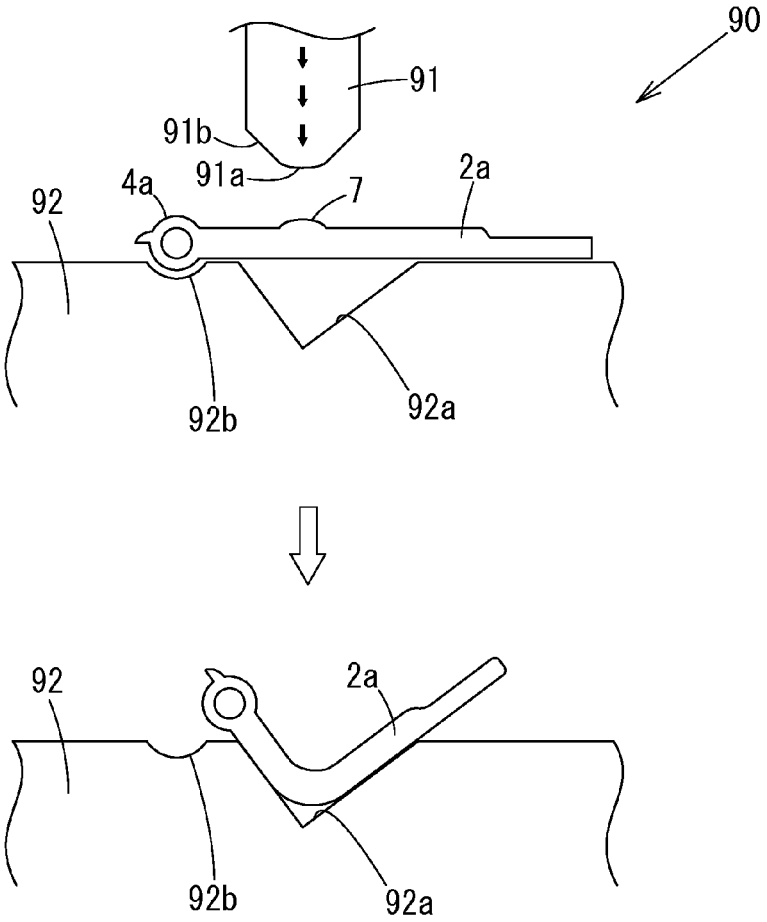
FIG. 16 illustrates a bending process according to the first embodiment of the present invention.
Figure 17:
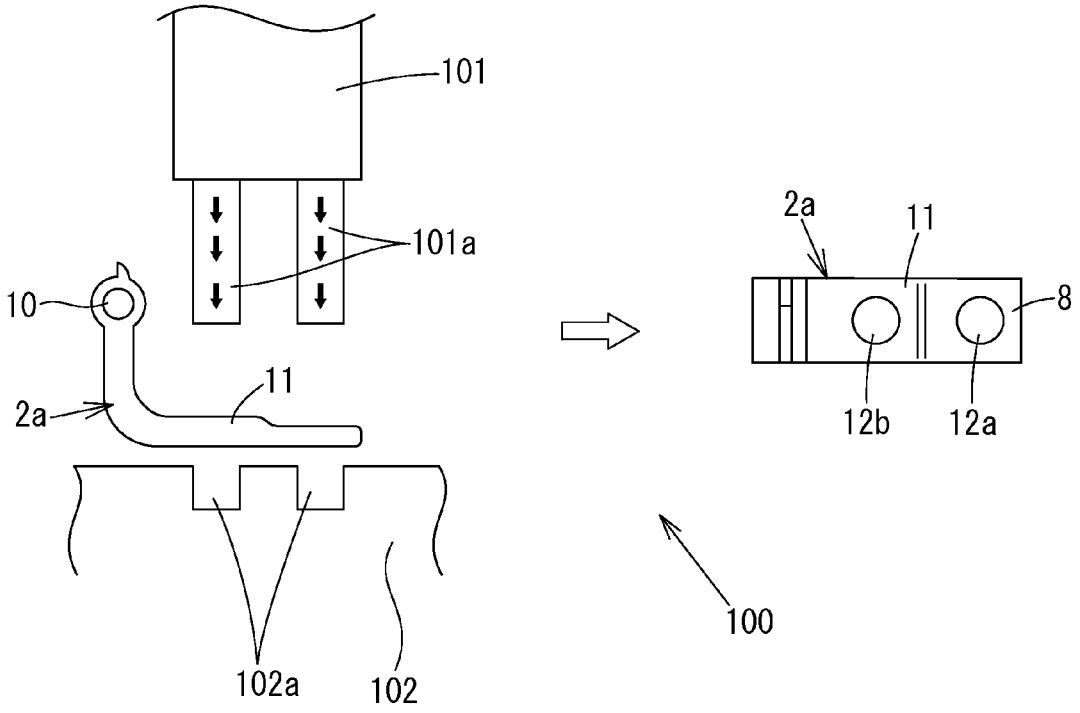
FIG. 17 illustrates a hole forming process according to the first embodiment of the present invention.

As illustrated in FIGS. 16 and 17, the blank 2*a* subjected to the shaft hole finishing process 80 is subjected to the bending process 90 and the hole forming process 100.

As illustrated in FIG. 16, in the bending process 90, the thick-wall portion 7 formed in the blank 2*a* through the wall thickness increasing process 40 is bent into an L shape. A bending punch 91 has a rounded portion 91*a* formed at the top end thereof. The rounded portion 91*a* has a large radius. The rounded portion 91*a* presses the thick-wall portion 7. The bending punch 91 further has a bending surface 91*b* for creating 90° bend. A bending die 92 has, on the side opposite to the thick-wall portion 7 of the blank 2*a*, a groove 92*a* having a shape of a right triangular prism and a groove 92*b* having a arc-like cross section that mates with the bulging part of the protrusion attached tubular bulging portion 4*a*.

The blank 2*a* is fixed to the bending die 92, and the bending punch 91 is lowered. Thus, the blank 2*a* is bent into an L shape so that the thick-wall portion 7 of the blank 2*a* is located on the inward side. In this manner, the bending process 90 is completed.

As illustrated in FIG. 17, in the hole forming process 100, mounting holes 12*a* and 12*b* each having a diameter of 14 mm are formed in a flat portion 11 of the L-shaped blank 2*a* where the shaft hole 10 is not formed. Note that the mounting holes 12*a* and 12*b* are used to mount the motor vehicle door hinge on the vehicle body. At that time, the mounting hole 12*a* is formed in the thin wall portion 8 formed through the thin-wall forming process 50, and the mounting hole 12*b* is formed in the middle of the flat portion 11.

Note that a hole punch 101 used in the hole forming process 100 has two cylindrical portions 101*a* each having an external diameter of 14 mm. A hole die 102 has two hole portions 102*a* each having a diameter of 14 mm.

When the hole forming process 100 is completed, the method for manufacturing the chassis-side door hinge 1*a* according to the first embodiment is completed.

While the above-described manufacturing method according to the first embodiment includes the planarization cutting process 20, the cold heading process 30, the wall thickness increasing process 40, the thin-wall forming process 50, the shape reforming process 60, the annealing process 65, the shaft hole forming process 70, the shaft hole finishing process 80, the bending process 90, and the hole forming process 100, the present invention is characterized by the cold heading process, the shaft hole forming process, and the shaft hole finishing process. Accordingly, the planarization cutting process, the wall thickness increasing process, the thin-wall forming process, the shape reforming process, the annealing process, the bending process, and the hole forming process may be removed or may be performed in another process.

A method for manufacturing a motor vehicle door hinge according to a second embodiment of the present invention is described next with reference to FIGS. 18 to 28.

The method for manufacturing a motor vehicle door hinge according to the first embodiment is related to a chassis-side door hinge. In contrast, the method for manufacturing a motor vehicle door hinge according to the second embodiment is related to a door-side door hinge to be attached to a door.

The structure of a door-side door hinge according to the second embodiment differs from that of the chassis-side door hinge according to the first embodiment in that while the chassis-side door hinge includes the protrusion serving as a door stopper, the door-side door hinge has a contact portion that is brought into contact with the protrusion. In addition, the door-side door hinge is smaller than the chassis-side door hinge due to restriction imposed on a mounting area.

The same numbering will be used in referring to a manufacturing process as is utilized above in describing the first embodiment and, therefore, description of a similar manufacturing process is not repeated or is briefly made.

Figure 18:
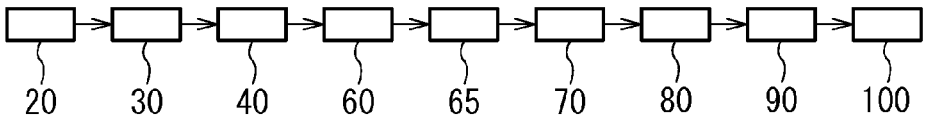
FIG. 18 is a block diagram according to a second embodiment of the present invention.
Figure 19:
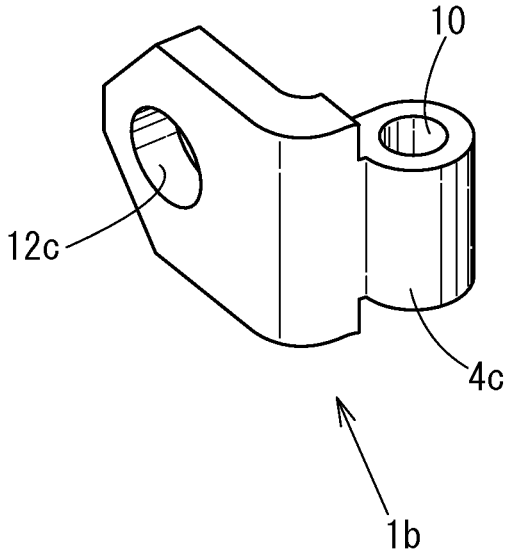
FIG. 19 is a perspective view of a door-side door hinge according to the second embodiment of the present invention.

As illustrated in FIG. 18, a manufacturing method according to the second embodiment includes the planarization cutting process 20, the cold heading process 30, the wall thickness increasing process 40, the shape reforming process 60, the annealing process 65, the shaft hole forming process 70, the shaft hole finishing process 80, the bending process 90, and the hole forming process 100. The thin-wall forming process 50 of the first embodiment is removed. A motor vehicle door hinge 1*b* in FIG. 19 illustrates the door-side door hinge 1*b* that is manufactured using the manufacturing method according to the second embodiment and that is to be attached to a door. In FIG. 19, the reference numeral "4*c*" denotes a cylindrical bulging portion, the reference numeral "10" denotes a shaft hole, and the reference numeral "12*c*" denotes a mounting hole.

The above-described processes 20 to 100 for the motor vehicle door hinge 1*b* are sequentially described next with reference to FIGS. 20 to 28. A difference from the first embodiment is primarily described.

Figure 20A:
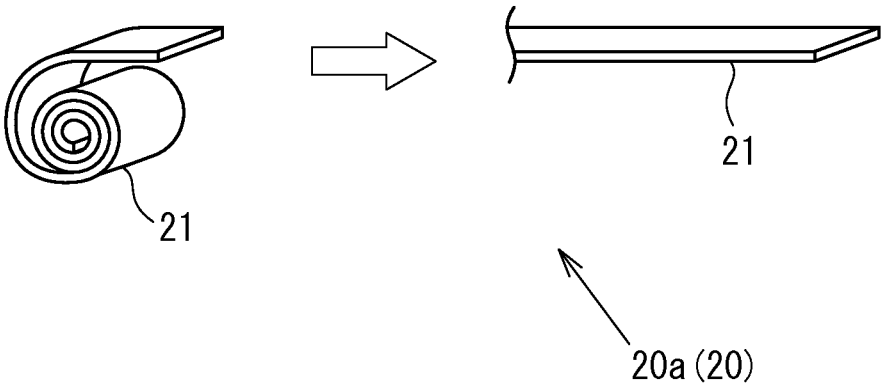
FIG. 20 illustrates a planarization cutting process according to the second embodiment of the present invention, where FIG. 20(*a*) illustrates a planarization process, and FIG. 20(*b*) illustrates a cutting process.
Figure 20B:
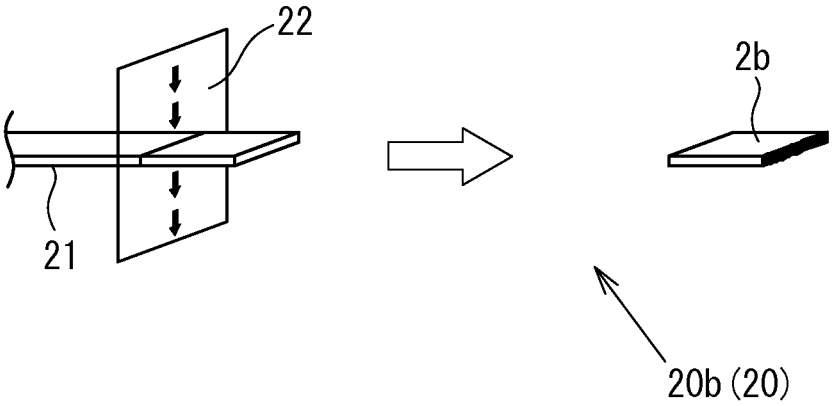

In a planarization process 20*a* illustrated in FIG. 20(*a*) of the planarization cutting process 20 illustrated in FIGS. 20(*a*) and 20(*b*), an SS400 steel coil stock 21 having a thickness of 9 mm and a height of 36 mm, which extends in the up and down direction when the motor vehicle door hinge 1*b* is used is planarized by a feed roll (not illustrated). In a cutting process 20*b* illustrated in FIG. 20(*b*), the steel coil stock 21 is cut into pieces each having a width of 67 mm by a cutting machine 22. In this way, a steel blank 2*b* having a thickness of 9 mm, a width of 67 mm, and a height of 36 mm is formed.

Figure 21:
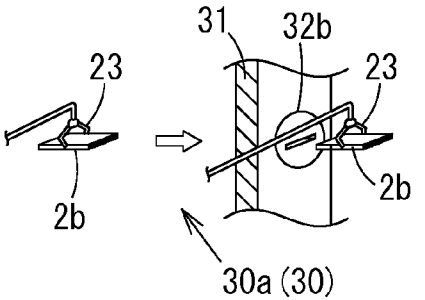
FIG. 21 illustrates a cold heading process according to the second embodiment of the present invention, where FIG. 21(*a*) illustrates a preparation process, FIG. 21(*b*) is a plan view of a cylindrical bulging portion, FIG. 21(*c*) is a cross-sectional view of a cold heading die, FIG. 21(*d*) illustrates a flat punch, FIG. 21(*e*) is a cross-sectional view of a cold heading punch, FIG. 21(*f*) illustrates a first process, FIG. 21(*g*) illustrates a second process, FIG. 21(*h*) illustrates a third process, and FIG. 21(*i*) illustrates a blank subjected to a cold heading process.
Figure 21:
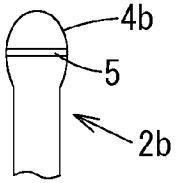
Figure 21:
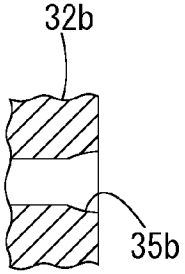
Figure 21:
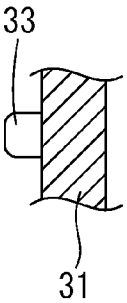
Figure 21:
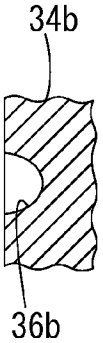
Figure 21:
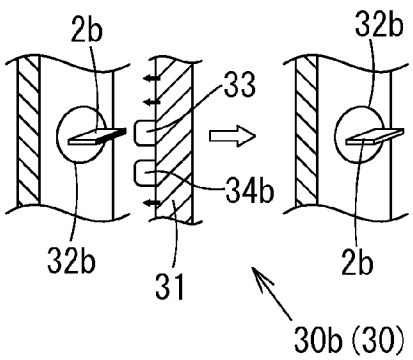
Figure 21:
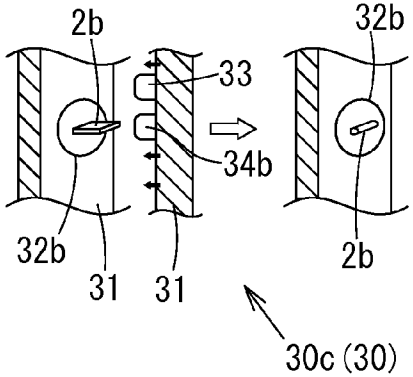
Figure 21:
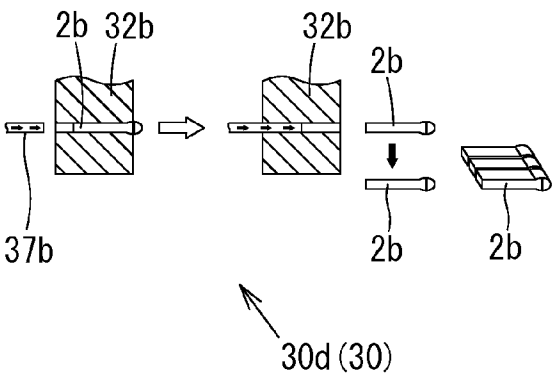
Figure 21:
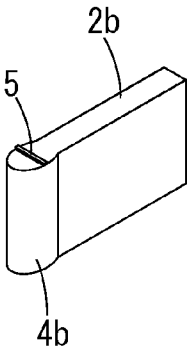

Subsequently, as illustrated in FIG. 21(*a*), in a preparation process 30*a* of the cold heading process 30 illustrated in FIGS. 21(*a*), 21(*b*), 21(*c*), 21(*d*), 21(*e*), 21(*f*), 21(*g*), and 21(*h*), the steel blank 2*b* formed in the planarization cutting process 20 is pinched by a transport claw 23 and is transported to a position in front of a cold heading die 32*b* of a double header machine 31 having the cold heading process 30.

As illustrated in a plan view of FIG. 21(*b*), through a cold heading process, a cylindrical bulging portion 4*b* that bulges in the thickness direction and has a horizontal cross section of an ellipse with a minor axis of 13 mm and a major axis of 16 mm is formed. Note that in FIG. 21(*b*), the reference numeral "5" represents a burr (described in more detail below).

The double header machine 31 includes a cold heading die 32*b* illustrated in FIG. 21(*c*), the flat punch 33 having a flat and smooth punch surface illustrated in FIG. 21(*d*), and a cold heading punch 34*b* illustrated in FIG. 21(*e*). As indicated by the partial enlarged cross-section views illustrated in FIGS. 21(*c*) and 21(*e*), the cold heading die 32*b* and the cold heading punch 34*b* have recesses 35*b* and 36*b* for forming the cylindrical bulging portion 4*b*, respectively, on the facing surfaces.

In a first process 30*b* of the cold heading process 30 performed by the double header machine 31, as illustrated in FIG. 21(*f*), a cutting surface of the blank 2*b* is fixed so as to protrude from the cold heading die 32*b* and is pressed by the flat punch 33. Thus, a shear droop and a roughness of the cutting surface of the blank 2*b* are reformed.

Subsequently, in a second process 30*c* of the cold heading process 30 performed by the double header machine 31, as illustrated in FIG. 21(*g*), the cylindrical bulging portion 4*b* is formed by cold heading using the cold heading punch 34*b* and the cold heading die 32*b*.

Thereafter, in a third process 30*d* of the cold heading process 30, as illustrated in FIG. 21(*h*), the blank 2*b* having the cylindrical bulging portion 4*b* formed therein is kicked out of the cold heading die 32*b* by a knock-out pin 37*b*. Thus, the cold heading process 30 is completed.

The cold heading punch 34*b* applies a pressing force to the cutting surface of the blank 2*b* such that the cold heading punch 34*b* is not brought into contact with the cold heading die 32*b* and performs the cold heading process. As illustrated in FIG. 21(*i*), the blank 2*b* formed through the cold heading process 30 has the burr 5 on the end surface of the cylindrical bulging portion 4*b* in the height direction. The burr 5 extends in a small gap formed between the cold heading punch 34*b* and the cold heading die 32*b*.

Note that since the blank 2*b* bulges in the circumferential direction of the cylindrical bulging portion 4*b*, a burr is negligibly formed in the circumferential direction.

Subsequently, the wall thickness increasing process 40, the shape reforming process 60, the shaft hole forming process 70, the shaft hole finishing process 80, the bending process 90, and the hole forming process 100 are performed using a 500-ton transfer press machine.

Figure 22:
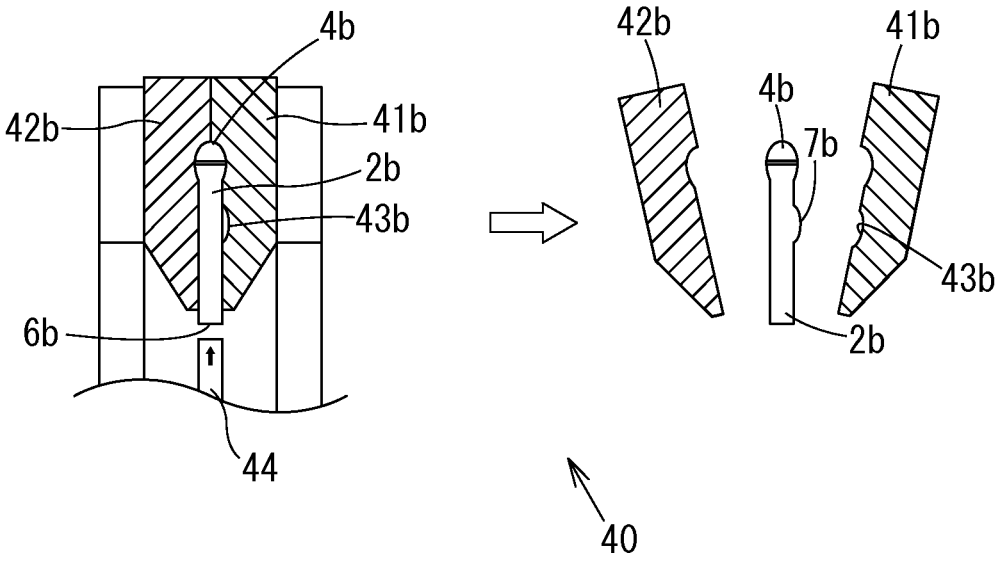
FIG. 22 is a diagram for illustrating a wall thickness increasing process according to the second embodiment of the present invention.

As illustrated in FIG. 22, in the wall thickness increasing process 40, the cylindrical bulging portion 4*b* is sandwiched by split mold dice 41*b* and 42*b* having a mating surface in the middle of the blank 2*b* in the thickness direction. The other end 6*b* of the blank 2*b* protrudes from the split mold dice 41*b* and 42*b*. In addition, the split mold die 41*b* has a back clearance 43*b* that allows the middle portion of the blank 2*b* to bulge thereinto in the thickness direction. By pressing the other end 6*b* of the blank 2*b* using a thick-wall forming punch 44, the wall thickness of the middle portion of the blank 2*b* can be increased.

In the wall thickness increasing process 40, a thick-wall portion 7*b* is formed in the middle of the blank 2*b*. Subsequently, in the bending process 90 (described in more detail below), the thick-wall portion 7*b* is bent into an L shape.

Figure 23A:
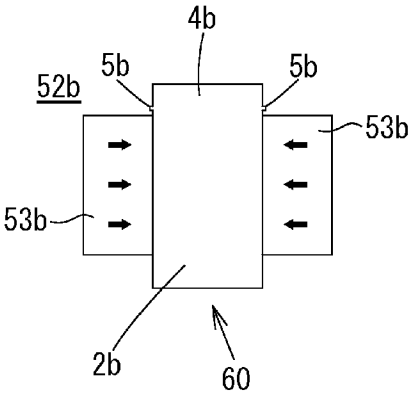
FIG. 23 is a diagram for illustrating a shape reforming process according to the second embodiment of the present invention, where FIG. 23(*a*) is a plan view and FIG. 23(*b*) is a side view, and FIG. 23(*c*) is a plan view of a shaped portion.
Figure 23B:
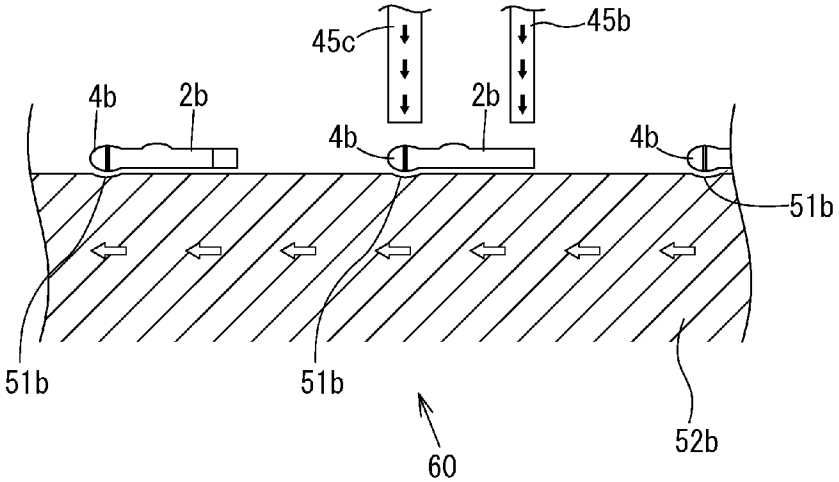
Figure 23C:
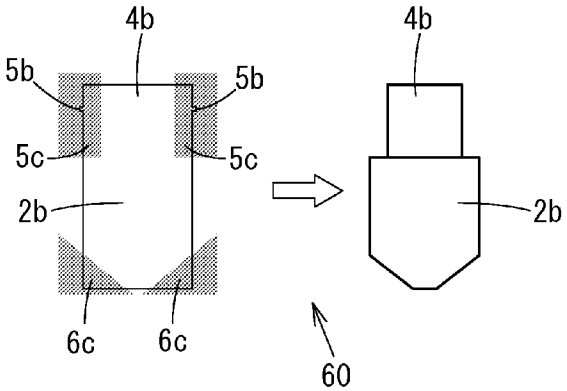

Thereafter, in the shape reforming process 60 illustrated in FIGS. 23(*a*), 23(*b*), and 23(*c*), the middle portion of the cylindrical bulging portion 4*b* of the blank 2*b* having the thick-wall portion 7*b* formed through the wall thickness increasing process 40 is pinched by a fixing tool 53*b* and is fixed onto a die 52*b* having a depression 51*b* that horizontally receives the cylindrical bulging portion 4*b*. As illustrated in FIG. 23(*c*), each of a burr 5*b* generated in the cold heading process 30 and both ends 5*c* of the cylindrical bulging portion 4*b* in the height direction are cut by 6 mm. In addition, cut-out portions 6*c* in the corners of the other end of the blank 2*b* are cut using shape reforming punches 45*b* and 45*c*.

The annealing process 65 is the same as that of the first embodiment and, therefore, description of the annealing process 65 is not repeated.

The shaft hole forming process 70 is described next with reference to FIGS. 24 to 26. In the shaft hole forming process 70, the shaft hole 10 that allows a hinge pin to be inserted thereinto throughout the shaft center of the cylindrical bulging portion 4*b* of the blank 2*b* subjected to the annealing process 65 is formed using the first punch 71 and a first die 172.

The first punch 71 is similar to that of the first embodiment and, therefore, description of the first punch 71 is not repeated. In addition, as illustrated in FIG. 25, the first die 172 illustrated in FIG. 24 includes an inner wall 172*a* that is spaced apart from the outer circumferential surface of the cylindrical bulging portion 4*b* of the blank 2*b* (indicated by a dotted line). A gap volume 172*b* formed between the outer circumferential surface of the cylindrical bulging portion 4*b* and the inner wall 172*a* has a size so that when the cylindrical bulging portion 4*b* of the blank 2*b* is punched by the first punch 71, the hole portion formed from the end at which machining of the first punch 71 starts to ⅘ the length of the cylindrical bulging portion 4*b* does not produce a punched slug and bulges outward, and a portion from ⅘ the length of the cylindrical bulging portion 4*b* to the end at which the machining of the first punch 71 ends is ejected as a punched slug.

In addition, the first die 172 has a positioning portion 172*c* formed therein. The top end of the cylindrical bulging portion 4*b* of the blank 2*b* is brought into contact with the positioning portion 172*c*. Thus, the outer circumferential surface of the blank 2*b* is inserted into an inner wall 172*d* so that any gap is not formed therebetween except for a portion that the cylindrical bulging portion 4*b* faces.

In addition, a portion of the first die 172 in which one of the cut-out portions 6*c* in the other end corner of the blank 2*b* (the upper cut-out portion 6*c*) is located functions as an empty portion 172*e* (refer to FIG. 26) in order to insert the blank 2*b* into the first die 172 from above. In addition, a portion in which the other cut-out portion 6*c* (the lower cut-out portion 6*c*) is located functions as a receiving portion 172*g* that mates with the lower cut-out portion 6*c*.

Figure 25:
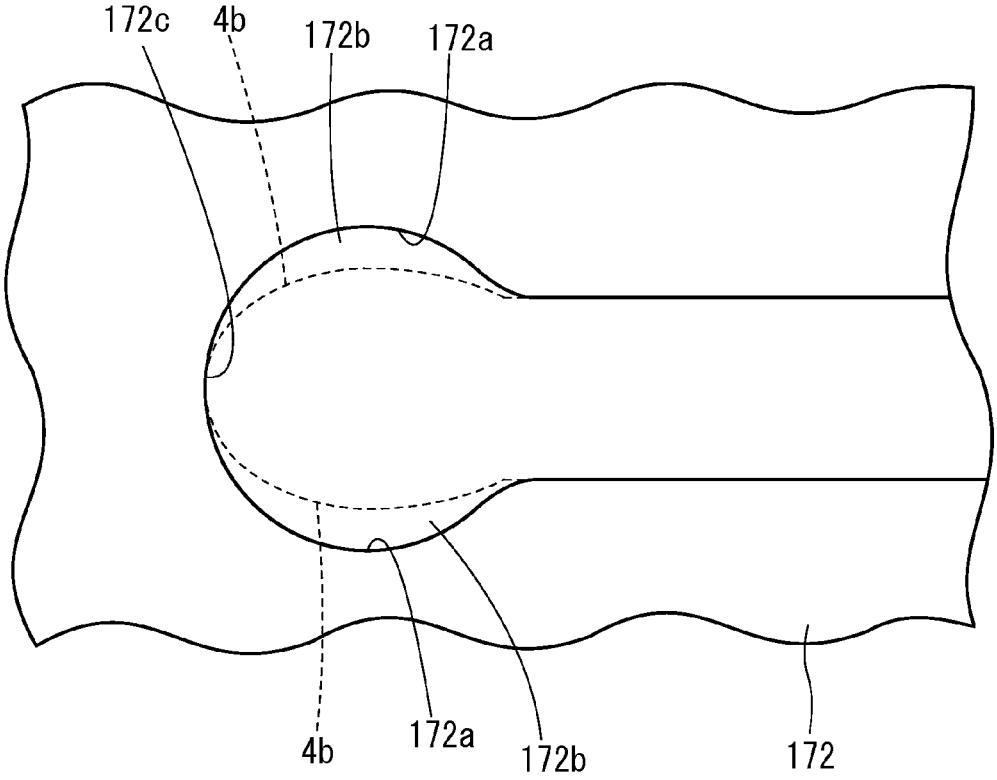
FIG. 25 is a partial enlarged plan view of a cylindrical bulging portion and a first die according to the second embodiment of the present invention.

Note that FIG. 25 is a partial enlarged view of the first die 172 having the cylindrical bulging portion 4*b* inserted thereinto before the cylindrical bulging portion 4*b* is punched by the first punch 71. The upper 6-mm portion and the lower 6-mm portion of the cylindrical bulging portion 4*b* are cut off through the shape reforming process 60 and, thus, the size of the cylindrical bulging portion 4*b* is 24 mm in the height direction. The shape of a portion of the first die 172 corresponding to the upper 6-mm part of the cylindrical bulging portion 4*b* is defined by an inner surface 172*f* (refer to FIG. 26) having an internal diameter of 16 mm in order to insert the blank 2*b* into the first die 172 from above.

The shaft hole 10 is formed in the shaft center of the cylindrical bulging portion 4*b* using the first punch 71, the first die 172, and the 500-ton transfer press machine.

Figure 26:
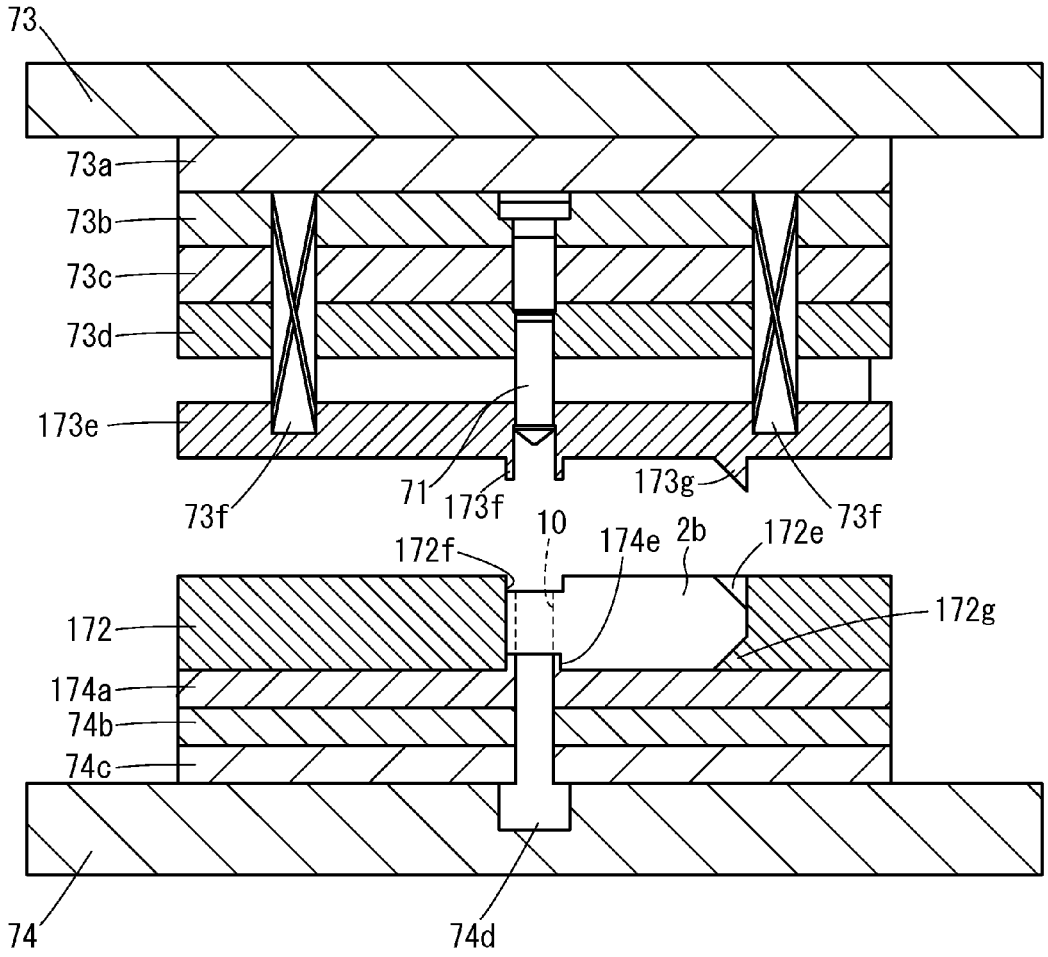
FIG. 26 is a cross-sectional view of an upper and lower die set used in a shaft hole forming process according to the second embodiment of the present invention.

As illustrated in FIG. 26, in the shaft hole forming process, the first punch 71 is attached to an upper die set 73 of the transfer press machine that moves up and down using, for example, a punch plate 73*a*, punch folders 73*b*, 73*c*, and 73*d*, a stripper 173*e*, and a spring 73*f*. In addition, the first die 172 is fixed to a lower die set 74 fixed to the transfer press machine using, for example, a die folder 174*a* and die plates 74*b* and 74*c*.

The stripper 173*e* has a hollow cylindrical portion 173*f* that mates with the upper 6-mm part of the cylindrical bulging portion 4*b* and a protruding portion 173*g* that mates with the empty portion 172*e* of the first die 172. The die folder 174*a* has a hollow cylindrical portion 174*e* that mates with the lower 6-mm part of the cylindrical bulging portion 4*b*.

The blank 2*b* is inserted into the first die 172. The upper die set 73 is lowered so that the stripper 173*e* of the upper die set 73 is brought into contact with the first die 172. Thereafter, the upper and lower surfaces of a portion of the blank 2*b* other than a portion of the shaft hole 10 formed in the blank 2*b* is fixed between the stripper 173*e* and the die folder 174*a* by the spring 73*f*. Subsequently, the first punch 71 is lowered. Thus, the shaft hole 10 is formed. At that time, a hole portion formed from the end at which machining of the first punch 71 starts to ⅘ the length of the shaft hole 10 does not produce a punched slug, and the cylindrical bulging portion 4*b* bulges outward and, thus, the gap volume 172*b* of the first die 172 is fully filled with the bulging portion. Thereafter, a hole portion formed from ⅘ the length of the shaft hole 10 to the end at which the machining of the first punch 71 ends produces a punched slug, and the punched slug is ejected to the outside through a slug ejection port 74*d*.

Subsequently, the upper die set 73 is raised to the original position, and the blank 2*b* having the shaft hole 10 formed therein is pushed upward out of the first die 172 by a hydraulic power unit (not illustrated). In this way, the shaft hole forming process 70 is completed.

As described above, the blank 2*b* subjected to the shaft hole forming process 70 has a tubular bulging portion 4*c* transformed from the cylindrical bulging portion 4*b* prior to the shaft hole forming process 70.

The blank 2*b* subjected to the shaft hole forming process 70 is upset by the transfer press machine, and the shaft hole 10 formed in the tubular bulging portion 4*c* is finished in the shaft hole finishing process 80.

Like the first embodiment, in the shaft hole finishing process 80, the shaft hole 10 formed in the tubular bulging portion 4*c* of the blank 2*b* through the shaft hole forming process 70 is accurately finished using a second punch and a second die (not illustrated).

The second punch is similar to the second punch 81 according to the first embodiment and, therefore, illustration and description of the second punch are not repeated.

Figure 24:
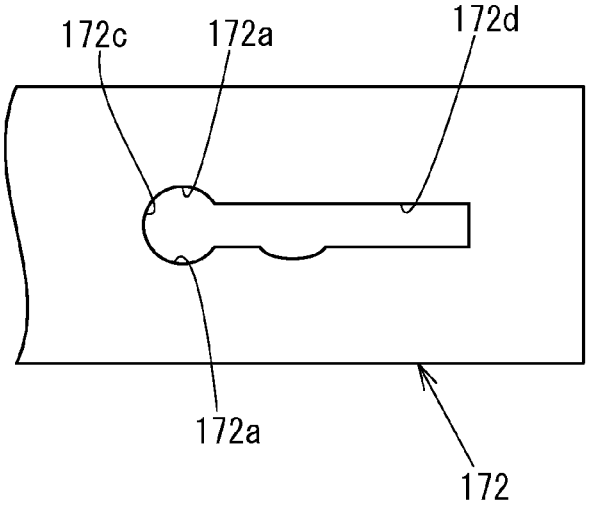
FIG. 24 is a plan view of a first die according to the second embodiment of the present invention.

In addition, since the blank 2*b* is upset from the position in the first die 172 and is inserted into the second die, the blank 2*b* is disposed symmetrically in the up and down direction with respect to the first die 172 illustrated in FIG. 24. Thus, illustration and description of the second die are not repeated.

As in the first embodiment, in the shaft hole finishing process 80, the transfer press machine that is used in the shaft hole forming process 70 is also used. The second punch is attached to the upper die set 73, and the second die is fixed to the lower die set 74. As in the shaft hole forming process 70, the upper die set 73 of the transfer press machine is moved up and down. Thus, as in the first embodiment, the shaft hole 10 is finished (not illustrated).

In addition, in the shaft hole finishing process 80, the largest diameter of the second punch 81 is larger than that of the first punch 71 used in the shaft hole forming process 70 by 0.2 mm, as in the first embodiment. However, the blank 2*b* cannot bulge outward due to the presence of the stripper 173*e* and the die folder 172 in the up and down direction and the second die 172 in the outer circumferential direction. Accordingly, although in the shaft hole finishing process 80, the shaft hole 10 is increased by only 0.2 mm, the excess thickness does not produce a punched slug. Instead, as illustrated in FIG. 15 of the first embodiment, a shear droop 10*a* is produced at the end at which machining of the shaft hole forming process 70 starts. The excess thickness fills in the shear droop 10*a*, or the excess thickness is absorbed in fine gaps formed between the tubular bulging portion 4*c* and the inner wall 172*a* of the second die 172.

Figure 27:
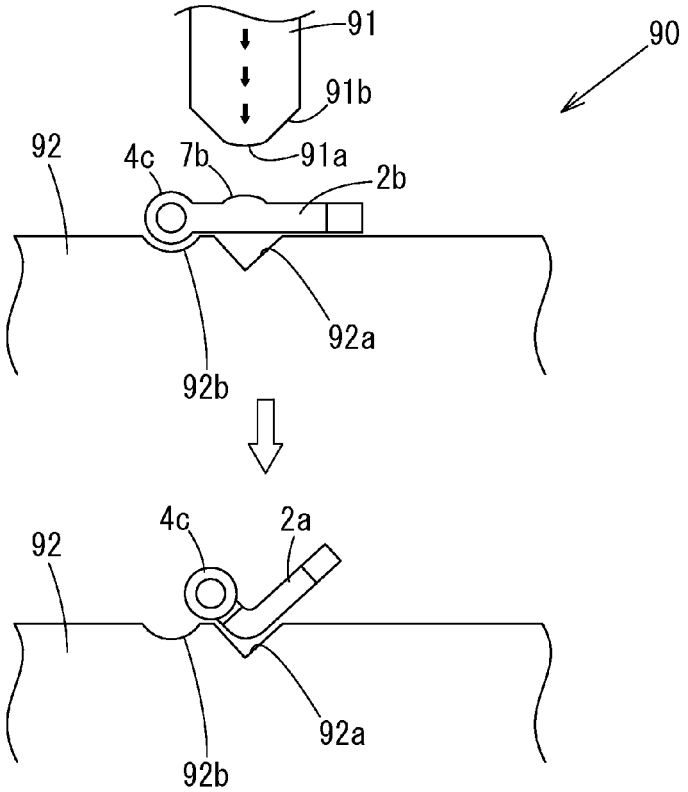
FIG. 27 illustrates a bending process according to the second embodiment of the present invention.
Figure 28:
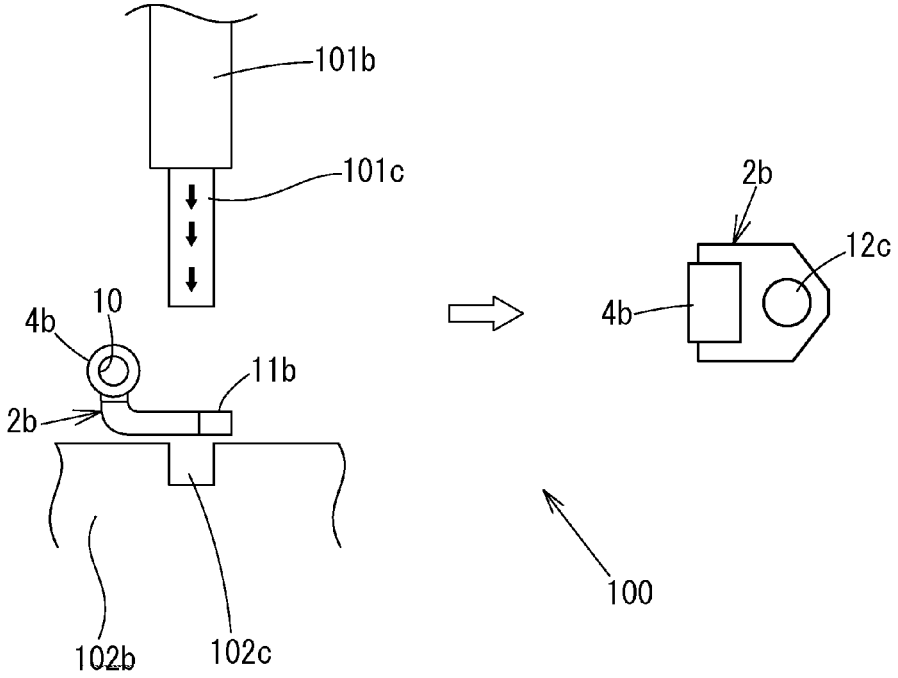
FIG. 28 illustrates a hole forming process according to the second embodiment of the present invention.

Thereafter, as illustrated in FIGS. 27 and 28, the blank 2*b* subjected to the shaft hole finishing process 80 is subjected to the bending process 90 and the hole forming process 100.

As in the first embodiment, in the bending process 90 illustrated in FIG. 27, the thick-wall portion 7*b* formed in the blank 2*b* through the wall thickness increasing process 40 is bent into an L shape. A bending punch 91 has a rounded portion 91*a* formed at the top end thereof. The rounded portion 91*a* has a large radius. The rounded portion 91*a* presses the thick-wall portion 7. The bending punch 91 further has a bending surface 91*b* for creating 90° bend. A bending die 92 has, on the side opposite to the thick-wall portion 7*b* of the blank 2*b*, a groove 92*a* having a shape of a right triangular prism and a groove 92*b* having a arc-like cross section that mates with the bulging part of the tubular bulging portion 4*c*.

Thereafter, the blank 2*b* is fixed to the bending die 92, and the bending punch 91 is lowered. Thus, the blank 2*b* is bent into an L shape so that the thick-wall portion 7*b* of the blank 2*b* is located on the inward side. In this manner, the bending process 90 is completed.

As illustrated in FIG. 28, in the hole forming process 100, a mounting hole 12*c* having a diameter of 14 mm is formed in a flat portion 11*b* of the L-shaped blank 2*b* without having the shaft hole 10. Note that the mounting hole 12*c* is used to mount the motor vehicle door hinge on the door.

Note that a hole punch 101*b* used in the hole forming process 100 has a cylindrical portion 101*c* with an external diameter of 14 mm, and a hole die 102*b* has a hole portion 102*c* with a diameter of 14 mm.

When the hole forming process 100 is completed, the method for manufacturing the motor vehicle door hinge 1*b* according to the second embodiment illustrated in FIG. 19 is completed.

While the above-described manufacturing method according to the second embodiment includes the planarization cutting process 20, the cold heading process 30, the wall thickness increasing process 40, the shape reforming process 60, the annealing process 65, the shaft hole forming process 70, the shaft hole finishing process 80, the bending process 90, and the hole forming process 100, the present invention is characterized by the cold heading process, the shaft hole forming process, and the shaft hole finishing process. Thus, the planarization cutting process, the wall thickness increasing process, the shape reforming process, the annealing process, the bending process, and the hole forming process may be removed or may be performed in another process.

While the above first to second embodiments have been described with reference to the planarization cutting process 20 in which the steel coil stock 21 is cut into blanks each having a predetermined width by the cutting machine 22, the motor vehicle door hinge may be manufactured from a blank having a predetermined size in advance. In such a case, the need for the planarization cutting process 20 and the first process of the cold heading process 30 can be eliminated.

A method for manufacturing a motor vehicle door hinge according to a third embodiment of the present invention is described next with reference to FIGS. 29 to 39.

Like the first embodiment, the method for manufacturing a motor vehicle door hinge according to the third embodiment is related to a chassis-side door hinge.

Figure 29:
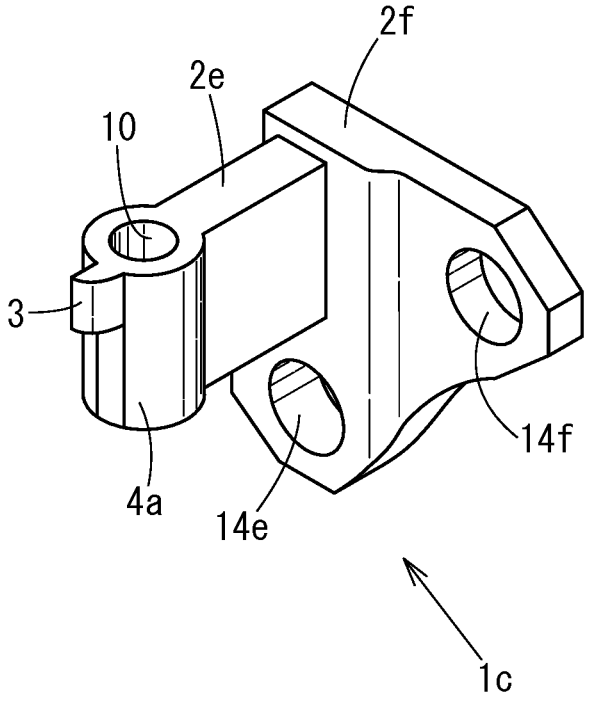
FIG. 29 is a perspective view of a chassis-side door hinge according to a third embodiment of the present invention.

FIG. 29 illustrates a chassis-side motor vehicle door hinge 1*c* manufactured using the manufacturing method according to the third embodiment. In FIG. 29, the reference numeral "2*e*" denotes a first member, the reference numeral "2*f*" denotes a second member, the reference numeral "3" denotes a protrusion portion, the reference numeral "4*a*" denotes a protrusion attached tubular bulging portion, the reference numeral "10" denotes a shaft hole, and the reference numerals "14*e*" and "14*f*" denote mounting holes.

In the first embodiment, the method for manufacturing a motor vehicle door hinge from a single blank 2*a*. However, according to the third embodiment, the first member 2*e* and the second member 2*f* are manufactured from a first blank 2*c* and a second blank 2*d*, respectively. Thereafter, the manufactured first member 2*e* and second member 2*f* are integrated into one body. In this manner, the chassis-side motor vehicle door hinge 1*c* is manufactured.

A method for manufacturing the first member 2*e* from the first blank 2*c*, a method for manufacturing the second member 2*f* from the second blank 2*d*, and a method for integrating the first member 2*e* with the second member 2*f* to manufacture the chassis-side motor vehicle door hinge 1*c* according to the third embodiment are described below.

The method for manufacturing the first member 2*e* according to the third embodiment includes some of the manufacturing processes that are the same as those of the method for manufacturing the chassis-side door hinge 1*a* according to the first embodiment. The same numbering will be used in referring to a manufacturing process as is utilized above in describing the first embodiment and, therefore, description of the manufacturing process is not repeated or is briefly made.

Figure 30:
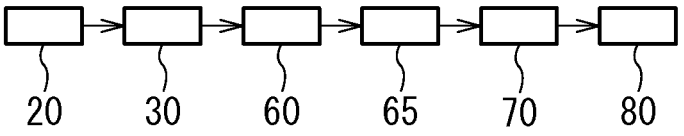
FIG. 30 is a block diagram according to the third embodiment of the present invention.

As illustrated in FIG. 30, the method for manufacturing the first member 2*e* illustrated in FIGS. 30 to 33 includes a planarization cutting process 20, a cold heading process 30, a shape reforming process 60, an annealing process 65, a shaft hole forming process 70, and a shaft hole finishing process 80. Unlike the first embodiment, the method for manufacturing the first member 2*e* does not include the wall thickness increasing process 40, the thin-wall forming process 50, the bending process 90, and the hole forming process 100.

In the planarization cutting process 20, an SS400 steel coil stock 21 having a thickness of 9 mm and a height of 25 mm, which extends in the up and down direction when the first member 2*e* is used as a door hinge, is planarized by a feed roll (not illustrated). Thereafter, the steel coil stock 21 is cut into pieces each having a width of 55 mm by a cutting machine 22.

In this way, the first steel blank 2*c* having a thickness of 9 mm, a width of 55 mm, and height of 25 mm is formed (refer to FIGS. 3(*a*) and 3(*b*)).

Figure 31:
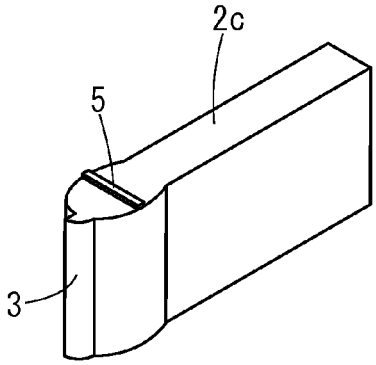
FIG. 31 is a perspective view of a blank subjected to a cold heading process according to the third embodiment of the present invention.

Since the cold heading process 30 is the same as that of the first embodiment and, therefore, description of the cold heading process 30 is not repeated. FIG. 31 illustrates the first blank 2*c* having the protrusion attached cylindrical bulging portion 4 formed therein through the cold heading process 30.

Thereafter, the subsequent shape reforming process 60, shaft hole forming process 70, and shaft hole finishing process 80 are performed using a 500-ton transfer press machine.

Figure 32A:
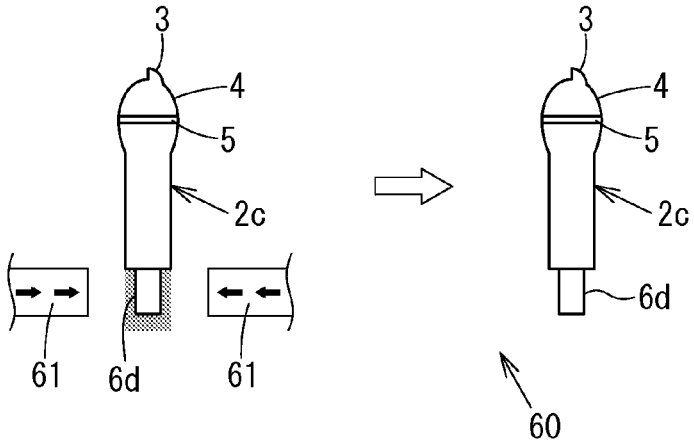
FIG. 32 illustrates a shape reforming process according to the third embodiment of the present invention, where FIG. 32(*a*) illustrates a stepped portion forming process, and FIG. 32(*b*) illustrates a shape reforming process.
Figure 32B:
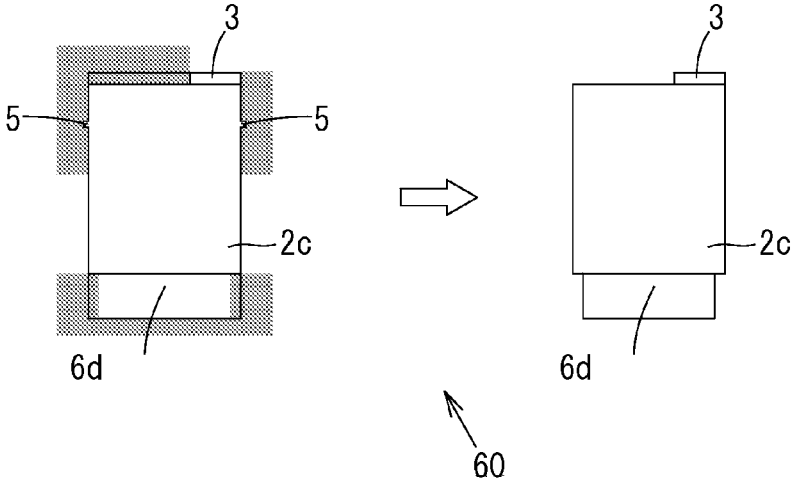

In the shape reforming process 60 illustrated in FIGS. 32(*a*) and 32(*b*), a stepped portion 6*d* is formed at an end of the first blank 2*c* opposite to the protrusion attached cylindrical bulging portion 4 using stepped portion forming punches 61 and 61. The thickness of a 10.5-mm end portion of the first material 2*c* is reduced from 9 mm to 5 mm. In addition, ⅔ the length of the protrusion portion 3 of the protrusion attached cylindrical bulging portion 4 in the height direction (in the right and left direction in the drawing), a burr 5 produced in the cold heading process 30, the excess thickness produced through formation of the stepped portion 6*d*, and the stepped portion 6*d* are cut off using a shape reforming punch (not illustrated) so that the height of the stepped portion 6*d* is reduced from 25 mm to 21 mm.

The first blank 2*c* that is processed before this point in time has been subjected to the annealing process 65, the shaft hole forming process 70, and the shaft hole finishing process 80. Since the processes 65, 70, and 80 are the same as those of the first embodiment, descriptions of the processes 65, 70, and 80 are not repeated.

Note that the width of the first blank 2*c* and the presence of the stepped portion 6*d* on the other side according to the third embodiment differ from those of the blank 2*a* according to the first embodiment. Accordingly, the upper die set and the lower die set that are suitable for the first blank 2*c* are used in the shaft hole forming process 70 and the shaft hole finishing process 80.

Figure 33:
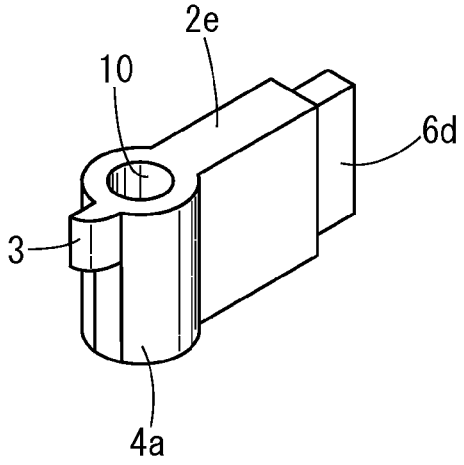
FIG. 33 is a perspective view of a first member according to the third embodiment of the present invention.

FIG. 33 illustrates the first member 2*e* manufactured from the first blank 2*c* in this manner.

While the above-described method for manufacturing the first member 2*e* according to the third embodiment includes the planarization cutting process 20, the cold heading process 30, the shape reforming process 60, the annealing process 65, the shaft hole forming process 70, and the shaft hole finishing process 80, the present invention is characterized by the cold heading process, the shaft hole forming process, and the shaft hole finishing process. Thus, the planarization cutting process, the shape reforming process, and the annealing process may be removed or may be performed in another process.

A method for manufacturing the second member 2*f* according to the third embodiment is described next with reference to FIGS. 34 to 36.

Figure 34:
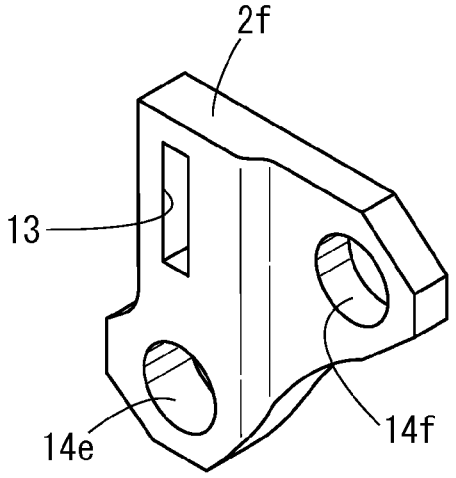
FIG. 34 is a perspective view of a second member according to the third embodiment of the present invention.

As illustrated in FIG. 34, the second member 2*f* is an attaching member attached to the vehicle body. The second member 2*f* is integrated with the first member 2*e* when used.

The second member 2*f* is a plate-like member having a polygonal shape, that is, a shape of a substantially right triangle when viewed from the front as the second member 2*f* is in use. The size of the second member 2*f* in the height direction is larger than the height of the first member 2*e* (the first blank 2*c*). One of the sides that form the right angle extends horizontally, and the other side extends vertically. The second member 2*f* has a quadrilateral hole 13 that mates with the stepped portion 6*d* of the first member 2*e* and mounting holes 14*e* and 14*f* used when the second member 2*f* is mounted on the vehicle body.

Figure 35:
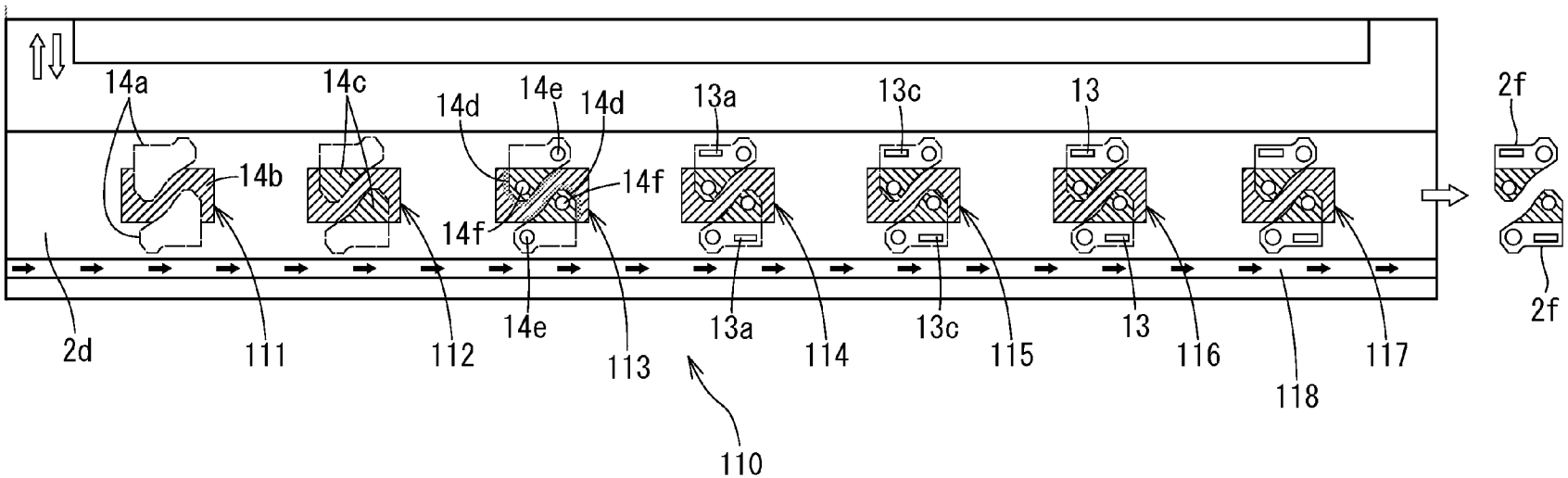
FIG. 35 illustrates a transfer press molding process according to the third embodiment of the present invention.

As illustrated in FIG. 35, according to the method for manufacturing the second member 2*f*, a transfer press molding process 110 is performed using a 500-ton transfer press machine.

A die and the processed shapes according to a method for manufacturing the second member 2*f* from the second blank 2*d* formed by planarizing the coil stock through the transfer press molding process 110 are described.

Dice separated into an upper die and a lower die are mounted on the 500-ton transfer press machine. An SS400 steel second blank 2*d* having a thickness of 9 mm and a height of 120 mm is placed between the upper die and the lower die and is pressed by the upper die and the lower die. In this way, the second blanks 2*d* are sequentially pressed into a shape. First process 111 to seventh process 117 described below are disposed on a single die surface at an even pitch. Each time a press operation or a punch operation of the press machine is performed, the second blank 2*d* is fed to the subsequent process by a feeding apparatus 118. Thus, a forming process is performed.

As indicated by a dashed line 14*a* illustrated in FIG. 35, in the first process 111, the outline of the upper and lower second members 2*f* is stamped with the two second member 2*f* partially connected with each other. In addition, the middle portion indicated as a slant line portion 14*b* is stamped out.

In the second process 112, a portion indicated as a slant line portion 14*c* is reformed by the die so that the thickness of the slant line portion 14*c* on the back of the plane of the drawing is decreased. Thus, the thickness is decreased from 9 mm to 6 mm.

In the third process 113, a portion 14*d* expanded over the outer circumferential surface in the second process 112 is cut off by the punch, and the mounting holes 14*e* and 14*f* used for mounting the second member 2*f* on the vehicle body are formed in the acute angle portions of the substantially right triangle portion.

In the fourth process 114, in order to form the quadrilateral hole 13, a quadrilateral hole 13*a* having a height and a width that are smaller than those of the stepped portion 6*d* of the first member 2*e* by 1 mm (i.e., a height of 20 mm and a width of 4 mm) is punched out.

In the fifth process 115, the quadrilateral hole 13*a* formed in the fourth process 114 is subjected to chamfering by pressing a punch in the shape of truncated pyramid into the quadrilateral hole 13*a* so that a taper surface 13*b* (refer to FIG. 36) of the quadrilateral hole 13*a* is formed. The taper surface 13*b* has a taper angle of 45° tapering from the punch entry side to the center of the quadrilateral hole 13*a*. The depth of the taper is 3 mm. In this manner, a quadrilateral hole 13*c* having the taper surface 13*b* is formed.

In the sixth process 116, in order to form the quadrilateral hole 13 that mates with the stepped portion 6*d* of the first member 2*e*, the quadrilateral hole 13*c* having the taper surface 13*b* formed through the fifth process 115 is punched using a punch having a height and a width that are larger than those of the punch used in the fourth process 114 by 1 mm (i.e., the quadrilateral hole 13 with a height of 21 mm and a width of 5 mm). In addition, the excess thickness generated in the fifth process 115 is made into a punched slug.

In the seventh process 117, the partially connected portion of the second member 2*f* is punched off. Thus, manufacturing of the second member 2*f* illustrated in FIG. 34 is completed.

Figure 36:
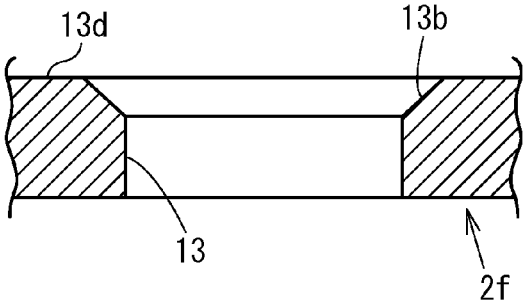
FIG. 36 is a cross-sectional view of a quadrilateral hole of the second member according to the third embodiment of the present invention.

In addition, as indicated by the partial enlarged cross-sectional view of FIG. 36, a plane of the quadrilateral hole 13 of the second member 2*f* on the side of the taper surface 13*b* formed in the sixth process 116 is used as an attaching surface 13*d* to be attached to the vehicle body. In the transfer press molding process 110 illustrated in FIG. 35, the second blank 2*d* is processed so that the attaching surface 13*d* to be attached to the vehicle body serves as the upper surface.

A method for integrating the first member 2*e* with the second member 2*f* and manufacturing the chassis-side motor vehicle door hinge 1*c* through an integration process 120 according to the third embodiment is described next.

Figure 37:
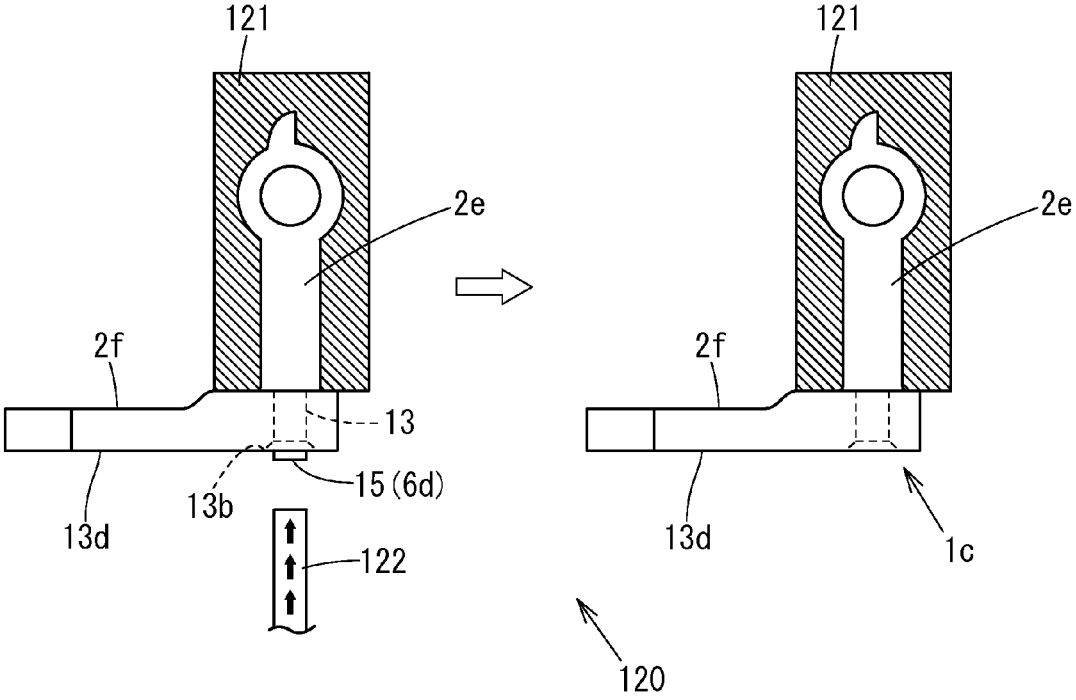
FIG. 37 illustrates an integration process according to the third embodiment of the present invention.

As illustrated in FIG. 37, the first member 2*e* is fixed to a die 121 of the 500-ton transfer press machine. Thereafter, the quadrilateral hole 13 of the second member 2*f* is fitted into the stepped portion 6*d* of the first member 2*e* from the side opposite to the taper surface 13*b*.

In this way, the end part of the stepped portion 6*d* of the first member 2*e* protrudes outwardly from the attaching surface 13*d* on the side of the taper surface 13*b* of the quadrilateral hole 13 by 1.5 mm as a protrusion portion 15.

The protrusion portion 15 of the first member 2*e* is subjected to a caulking process using a punch 122. Thus, the protrusion portion 15 is crushed into a space formed between the taper surface 13*b* of the quadrilateral hole 13 and the stepped portion 6*d* so that a caulked portion is flush with the attaching surface 13*d*.

Through such an integration process 120, the first member 2*e* is firmly integrated with the second member 2*f*. Thus, the chassis-side motor vehicle door hinge 1*c* is manufactured.

While the above third embodiment has been described with reference to the second member 2*f* produced through the transfer press molding process 110, the second member 2*f* can be press-formed using an individual die. In addition, the second member 2*f* is formed so as to have a shape of a right triangle when viewed from the front during use. However, the shape may be a rectangular shape.

In addition, while the above third embodiment has been described with reference to a process in which the taper surface 13*b* is provided in the quadrilateral hole 13 of the second member 2*f* and, thereafter, the first member 2*e* is integrated with the second member 2*f* using a caulking process, the first member 2*e* can be integrated with the second member 2*f* by a caulking process without providing the taper surface 13*b*.

Figure 38:
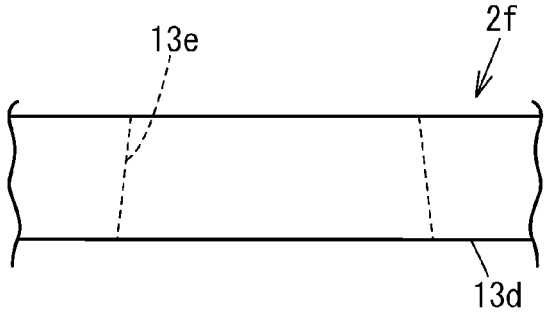
FIG. 38 illustrates a quadrilateral hole of a second member according to a modification of the third embodiment of the present invention.

Furthermore, while the above third embodiment has been described with reference to the taper surface 13*b* provided in the quadrilateral hole 13 of the second member 2*f* as illustrated in FIG. 36, the shape of the taper surface 13*b* can be changed so that the substantially entire quadrilateral hole can be made into a taper surface 13*e*, as indicated by a modification illustrated in FIG. 38.

Figure 39:
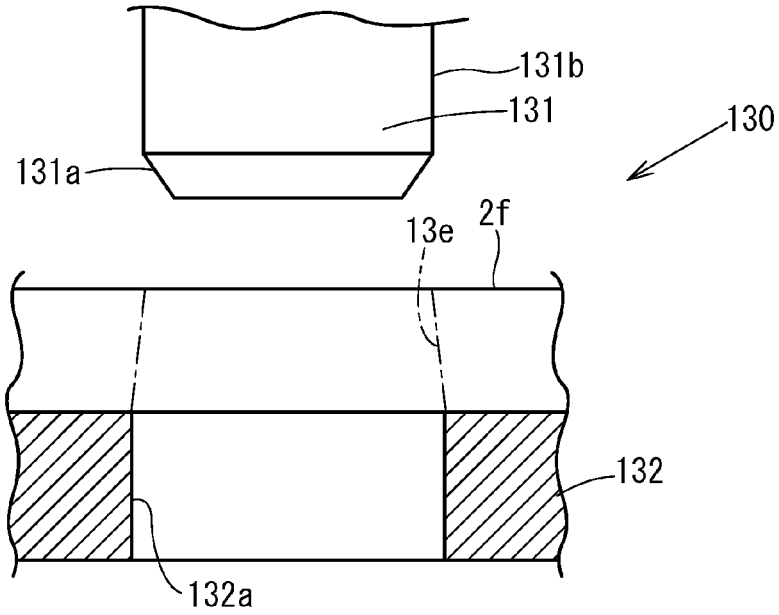
FIG. 39 illustrates a taper surface forming process according to the third embodiment of the present invention.

In such a case, the taper surface 13*e* can be formed using, instead of the fourth process 114, the fifth process 115, and the sixth process 116, a taper surface forming process 130 illustrated in FIG. 39. In the taper surface forming process 130, a punch 131 in the shape of truncated pyramid is used. A truncated pyramid 131*a* has a height of 3 mm and an angle of 60°. A quadrangular prism 131*b* has a size of 21 mm×5 mm that is the same as the size of the stepped portion 6*d* of the first member 2*e*.

In addition, a quadrilateral hole 132*a* having a size of 23 mm×7 mm is formed in a die 132. By forming the taper surface 13*e* of the quadrilateral hole 13 in this manner, the manufacturing processes and production of the dice can be simplified.

While the above first and third embodiments have been described with reference to a method for manufacturing a chassis-side door hinge having the vehicle door stopper protrusion portion 3, the need for the door stopper protrusion portion 3 can be eliminated.

While the above first to third embodiments have been described with reference to the cold heading process 30 using the double header machine 31, a parts former machine or a bolt former machine can be used instead of a double header machine.

While the above first to third embodiments have been described with reference to the annealing process on the basis of a transformation temperature, soft annealing in which a temperature that is lower than or equal to the transformation temperature is maintained may be employed.

In the above-described first to third embodiments, each of the first punch 71 and the second punch 81 has a top end having a cone angle of 90°. It is desirable that the cone angle be in the range from 70° to 120°.

In particular, if the cone angle of the first punch 71 is smaller than 70°, the excess thickness of the shaft hole moves in the circumferential direction of the punch and, therefore, the stress of the punch is increased. Thus, the blank is easily damaged. Accordingly, that cone angle is not desirable.

In addition, if the cone angle of the first punch 71 is larger than 120°, a large pushing force is exerted on the front of the shaft hole and, therefore, a portion in the vicinity of the shaft hole is pulled in the penetrating direction, therefore, the stress of the punch is also increased. Thus, the blank is easily damaged. In addition, the shear droop formed at the end of the shaft hole at which machining of the punch starts is increased. Thus, the shear droop prevents a practical use. Accordingly, that cone angle is not desirable.

Note that the shape of the second punch 81 may be a truncated cone instead of a cone.

In addition, in the above-described first to third embodiments, for the first die 72 and the first die 172, the gap volume 72*b* is formed between the outer circumferential surface of the cylindrical bulging portion 4 and the inner wall 72*a* of the first die 72, and the gap volumes 172*b* is formed between the outer circumferential surface of the cylindrical bulging portion 4*b* and the inner wall 172*a* of the first die 172. At that time, the sizes of the gap volumes 72*b* and 172*b* are set so that when the first punch 71 punches the cylindrical bulging portions 4 and 4*b* of the blanks 2*a*, 2*b*, and 2*c*, a hole portion formed from the end at which machining of the first punch 71 starts to ⅘ the length of the cylindrical bulging portion 4 or 4*b* bulges outward without producing a punched slug and, in addition, a hole portion formed from ⅘ the length to the end at which the machining of the first punch 71 ends produces a punched slug which is ejected. However, the value set to ⅘ the length may be changed to a value in the range from ¾ to ⅚ the length.

If the value is set to a value less than ¾ the length, each of the cylindrical bulging portions 4 and 4*b* does not bulge outward into the lower portion of the gap volume. If the value is set to a value greater than ⅚ the length, the stress that acts on the first punch is excessively increased.

Furthermore, while the above first to third embodiments have been described with reference to the cylindrical bulging portions 4 and 4*b* having a horizontal cross section of an elliptic shape and formed through the cold heading process 30, a protrusion attached cylindrical bulging portion 4*d* or a cylindrical bulging portion 4*e* having a horizontal cross section of a circular shape illustrated in FIGS. 40(*a*) and 40(*b*) may be employed. In such a case, an appropriate contact portion is formed in each of the blanks 2*a*, 2*b*, and 2*c*. A positioning portion corresponding to the contact portion is formed in each of the first dice 72 and 172 instead of the positioning portions 72*c* and 172*c* with which the top end of the cylindrical bulging portion 4 or 4*b* of the blanks 2*a*, 2*b*, and 2*c* is in contact.

Figure 40A:
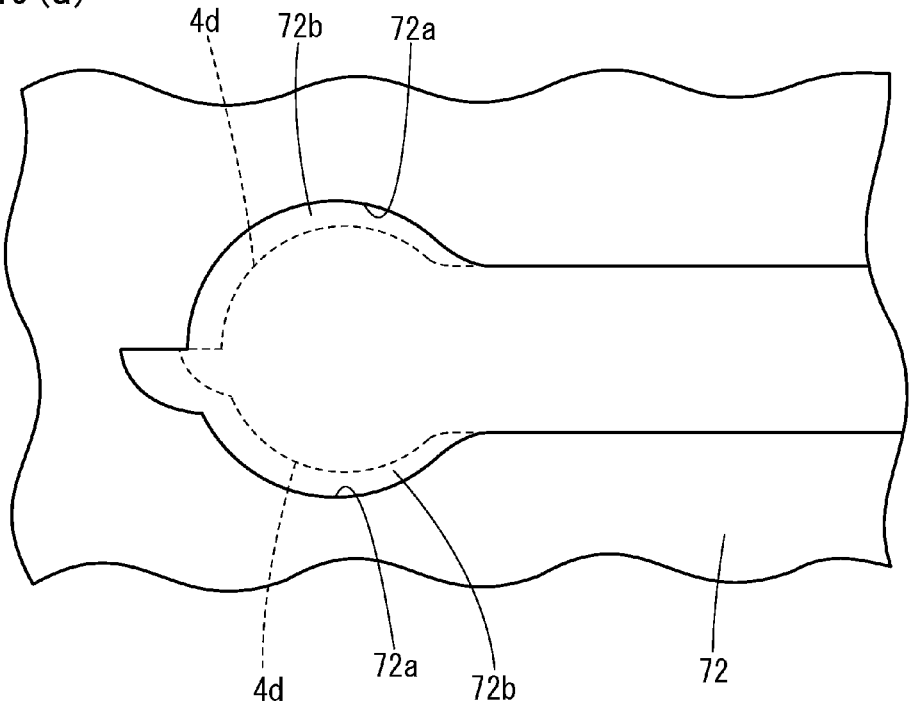
FIG. 40 is a partial enlarged plan view according to a modification of the first to third embodiments of the present invention, where FIG. 40(*a*) illustrates a protrusion attached cylindrical bulging portion and the first die and FIG. 40(*b*) illustrates a cylindrical bulging portion and the first die.
Figure 40B:
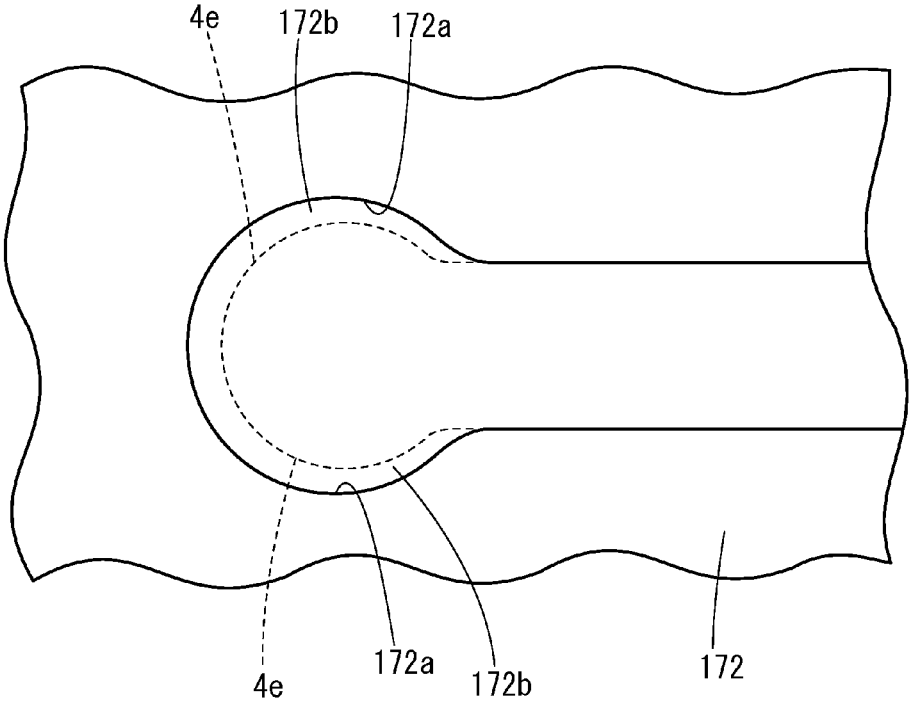

Note that FIG. 40(*a*) is a partial enlarged plan view of the protrusion attached cylindrical bulging portion 4*d* and the first die 72. FIG. 40(*a*) corresponds to FIG. 10 of the first embodiment. In addition, FIG. 40(*b*) is a partial enlarged plan view of the cylindrical bulging portion 4*e* and the first die 172. FIG. 40(*b*) corresponds to FIG. 25 of the second embodiment.

Still furthermore, while the above first to third embodiments have been described with reference to the annealing process 65 performed after the shape reforming process 60 is completed and before the shaft hole forming process 70 is started in order to remove work hardening generated in the processes prior to the shaft hole forming process 70 as illustrated in FIGS. 1, 18, and 30, an annealing process may be performed after the cold heading process 30 is performed and before the wall thickness increasing process 40 is started in the first and second embodiment (before the shape reforming process 60 is started in the third embodiment), since work hardening is generated in the protrusion attached cylindrical bulging portions 4 and 4*d* and the cylindrical bulging portions 4*b* and 4*e* primarily in the cold heading process 30.

By performing the annealing process immediately after the cold heading process 30 is performed in this manner, all of the processes subsequent to the cold heading process 30 can be continuously performed using a transfer press machine. For example, in the first embodiment, the wall thickness increasing process 40, the thin-wall forming process 50, the shape reforming process 60, the shaft hole forming process 70, the shaft hole finishing process 80, the bending process 90, and the hole forming process 100 can be advantageously performed by one operation of the transfer press machine at the same time while feeding the blank 2*a*, 2*b*, or 2*c* to the next process each time the transfer press machine operates.

Yet still furthermore, while the above first to third embodiments have been described with reference to the shaft hole forming process 70 and the shaft hole finishing process 80 performed by cold working after the annealing process 65 is performed, the shaft hole forming process and the shaft hole finishing process can be performed by warm working.

If the shaft hole forming process and the shaft hole finishing process can be performed by warm working, the temperature of the protrusion attached cylindrical bulging portion is set to a temperature in the range from 450° to 900°. The protrusion attached cylindrical bulging portion is heated by a high-frequency heating apparatus attached to the transfer press machine.

It is desirable that the temperature of the protrusion attached cylindrical bulging portion be set to a temperature in the range from 600° to 800° and is more desirable that the temperature be set to a temperature in the range from 650° to 750°.

In such a case, the sizes of the first punch, the first die, the second punch, and the second die are determined while taking into account the thermal expansion of the blank occurring during warm working and the thermal expansion of the product occurring during use at a room temperature.

That is, since the punches and dice are made of a material having a low coefficient of thermal expansion, the sizes of the first punch, the first die, the second punch, and the second die are produced so as to be larger than the design values thereof for a room temperature while taking into account the differences of the coefficient of thermal expansion.

If cold working is employed, the stress that acts on the first punch and the first die in the shaft hole forming step is increased and, thus, the volume of the press machine is increased. However, the working accuracy is advantageously increased. In contrast, if warm working is employed, the need for the annealing process is eliminated and, thus, the volume of the press machine can be decreased. However, a high-frequency heating apparatus is disadvantageously required. In addition, the working accuracy is disadvantageously lower than that in cold working.

A method for manufacturing a motor vehicle door hinge according to a fourth embodiment of the present invention is described next with reference to FIGS. 41(*a*) and 41(*b*) and FIGS. 42(*a*) and 42(*b*).

According to the fourth embodiment, a motor vehicle door hinge pair 1*d* and a motor vehicle door hinge pair 1*e* are manufactured using the door-side motor vehicle door hinge 1*b* produced by the method for manufacturing a motor vehicle door hinge according to the second embodiment and one of the chassis-side door hinge 1*a* produced by the method for manufacturing a motor vehicle door hinge according to the first embodiment and the chassis-side motor vehicle door hinge 1*c* produced by the method for manufacturing a motor vehicle door hinge according to the third embodiment.

Figure 41A:
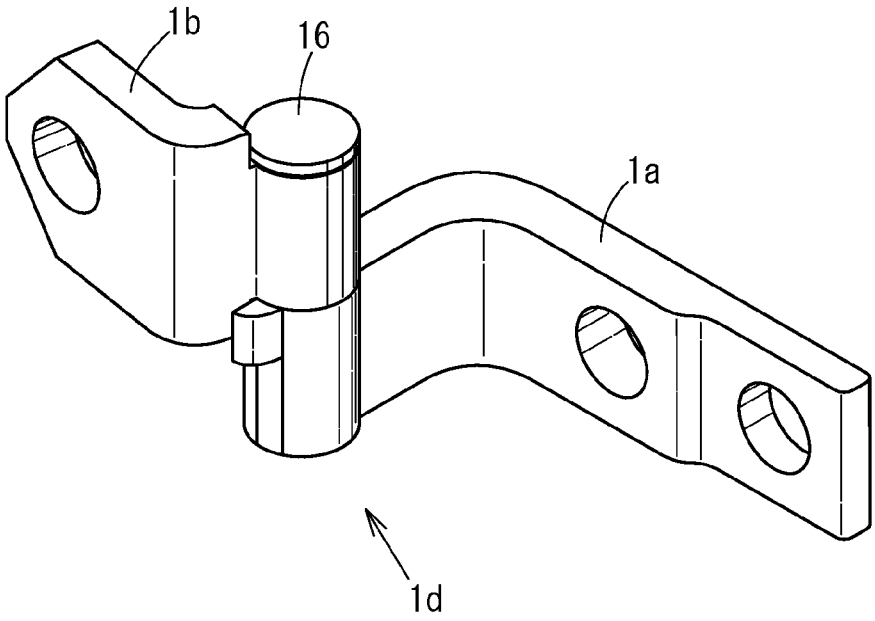
FIG. 41 illustrates a pair of motor vehicle door hinges according to a fourth embodiment of the present invention, where FIG. 41(*a*) is a perspective view and FIG. 41(*b*) is a front view.
Figure 41B:
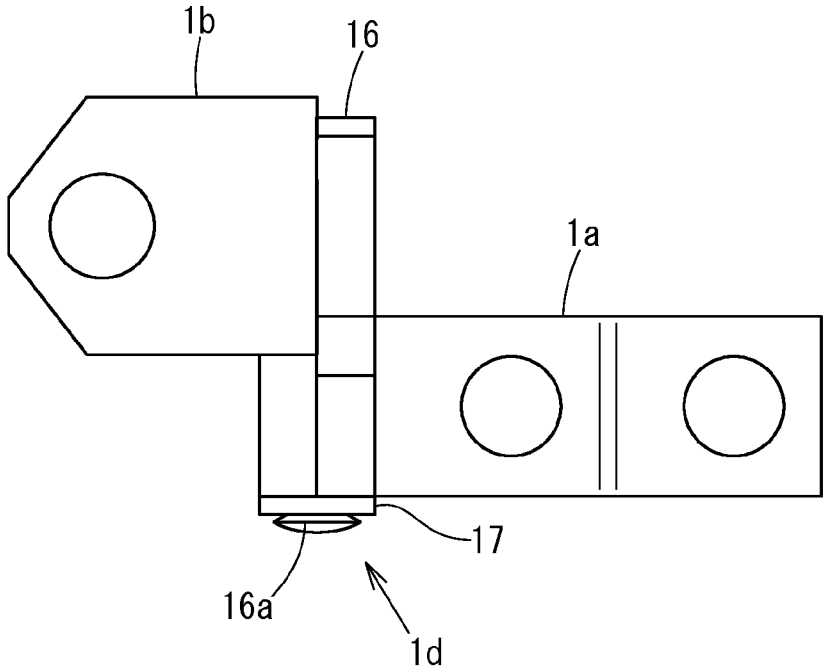

FIGS. 41(*a*) and 41(*b*) illustrate the motor vehicle door hinge pair 1*d* produced from the chassis-side door hinge 1*a* manufactured in the first embodiment and to be attached to a vehicle body and the door-side door hinge 1*b* manufactured in the second embodiment. A tubular plastic shock-absorbing member (not illustrated) is inserted into each of the above-described shaft holes of the door hinges 1*a* and 1*b*. A head hinge pin 16 is inserted into the two plastic shock-absorbing members and a washer 17 so as to pass through the two plastic shock-absorbing members and the washer 17. Thereafter, the end portion 16*a* of the head hinge pin 16 is subjected to a caulking process. In this manner, the motor vehicle door hinge pair 1*d* is produced.

Figure 42:
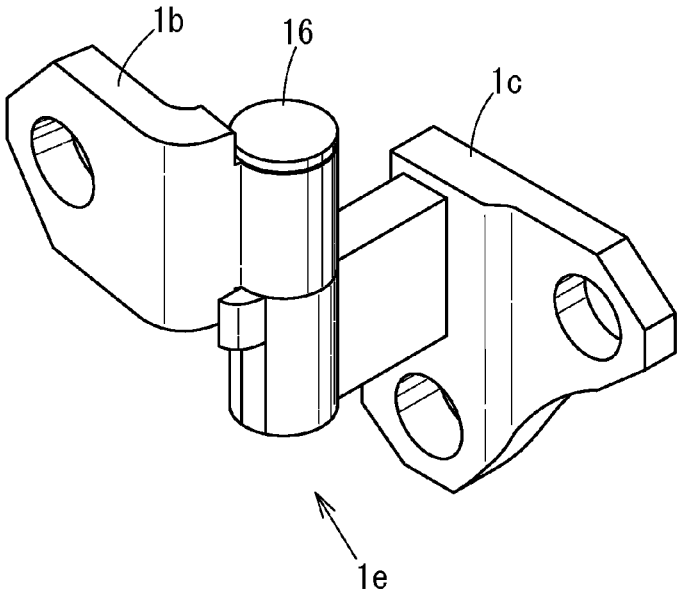
FIG. 42 illustrates a pair of motor vehicle door hinges according to a modification of the fourth embodiment of the present invention, where FIG. 42(*a*) is a perspective view and FIG. 42(*b*) is a front view.
Figure 42:
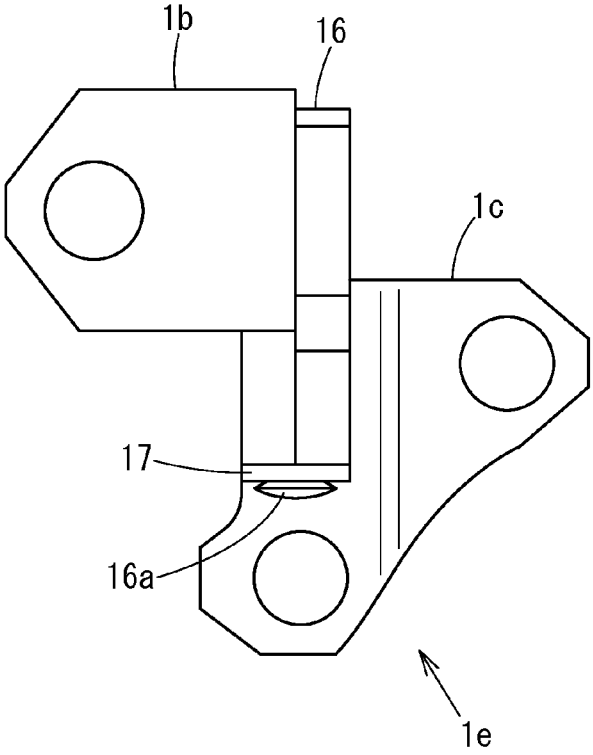

In addition, FIGS. 42(*a*) and 42(*b*) illustrate the motor vehicle door hinge pair 1*e* formed from the chassis-side door hinge 1*c* that is manufactured in the third embodiment and that is to be attached to a vehicle body and the door-side door hinge 1*b* manufactured in the second embodiment. A tubular plastic shock-absorbing member (not illustrated) is inserted into each of the above-described shaft holes of the door hinges 1*c* and 1*b*. A head hinge pin 16 is inserted into the two plastic shock-absorbing members and a washer 17 so as to pass through the two plastic shock-absorbing members and the washer 17. Thereafter, the end portion 16*a* of the head hinge pin 16 is subjected to a caulking process. In this manner, the motor vehicle door hinge pair 1*e* is produced.

While the above first to fourth embodiments have been described with reference to a method for manufacturing a motor vehicle door hinge suitable for large cars and high-class cars having a heavy-weight door, it is appreciated that the first to fourth embodiments are applicable to small cars and standard-sized cars having a light-weight door. For small cars and standard-sized cars, the exemplary sizes shown in the above-described embodiments are reduced.

REFERENCE SIGNS LIST

1*a*, 1*c* chassis-side door hinge
1*b* door-side door hinge
2*a*, 2*b* blank
2*c* first blank
2*d* second blank
2*e* first member
2*f* second member
3 protrusion portion
4, 4*d* protrusion attached cylindrical bulging portion
4*a* protrusion attached tubular bulging portion
4*b*, 4*e* cylindrical bulging portion
4*c* tubular bulging portion

6*d* stepped portion
7, 7*b* thick-wall portion
10 shaft hole
11 flat portion
12*a*, 12*b*, 12*c* mounting hole
13, 13*a*, 13*c* quadrilateral hole
13*b*, 13*e* taper surface
14*e*, 14*f* mounting hole
16 head hinge pin
16*a* end portion
17 washer
30 cold heading process
40 wall thickness increasing process
41, 41*b*, 42, 42*b* split mold die
43, 43*b* back clearance
44 thick-wall forming punch
60 shape reforming process
65 annealing process
70 shaft hole forming process
71 first punch
72, 172 first die
72*a*, 172*a* inner wall
72*b*, 172*b* gap volume
80 shaft hole finishing process
81 second punch
82 second die

The invention claimed is:

1. A method for manufacturing a motor vehicle door hinge from a steel plate blank having predetermined thickness, width, and height using processes including cold heading and punching, the method comprising:

a cold heading step of forming, at one end of the blank in the width direction, a cylindrical bulging portion having a bulged cylindrical shape bulging in the thickness direction so as to have a horizontal cross section of a circular shape or an elliptical shape and extending in the height direction by cold heading;

a shaft hole forming step of forming a shaft hole that passes through the cylindrical bulging portion along the shaft axis using a first punch and a first die, the shaft hole allowing a hinge pin to pass therethrough; and a shaft hole finishing step of punching the shaft hole formed in the shaft hole forming step from the end at which machining of the first punch ends using a second punch and a second die;

wherein a height of the cylindrical bulging portion of the shaft hole formed in the shaft hole forming step is twice or more a diameter of the shaft hole, and wherein the first punch used in the shaft hole forming step has a top end having a shape of a cone with a cone angle in the range from 70° to 120°, and wherein the first die has an inner wall having a gap relative to an outer circumferential surface of the cylindrical bulging portion of the blank, and the size of a gap volume formed by the outer circumferential surface of the cylindrical bulging portion and the inner wall is set so that when the first punch punches the cylindrical bulging portion of the blank, a hole portion formed from the end at which machining of the first punch starts to a predetermined length position does not produce a punched slug and the cylindrical bulging portion bulges outward and a hole portion from the predetermined length position to the end at which the machining of the first punch ends produces a punched slug to be ejected, and wherein the second die has a shape substantially the same as the shape of the first die, and wherein the second punch has a top end having a shape of a truncated cone or a cone with a cone angle in the range from 70° to 120° and a largest diameter that is larger than that of the first punch by 0.1 mm to 0.3 mm.

2. The method for manufacturing a motor vehicle door hinge according to claim 1, further comprising;

an annealing step of performing one of spheroidizing annealing and soft annealing on the blank after the cold heading step and before the shaft hole forming step;

wherein the shaft hole forming step is performed by cold working.

3. The method for manufacturing a motor vehicle door hinge according to claim 1, wherein in the shaft hole forming step, the cylindrical bulging portion is subjected to warm working at a temperature in the range from 450° C. to 900° C.

4. The method for manufacturing a motor vehicle door hinge according to claim 1, further comprising:

a wall thickness increasing step of sandwiching the cylindrical bulging portion formed at one end of the blank by a split mold die having a back clearance that allows the middle portion of the blank to bulge in the thickness direction so that the other end protrudes from the split mold die and increasing a wall thickness of the middle portion of the blank by pressing the other end of the blank using a punch; and a bending step of bending a thick-wall portion of the blank formed in the wall thickness increasing step into an L shape using press working;

wherein the shaft hole forming step and the shaft hole finishing step are performed after the wall thickness increasing step is performed, and wherein after the shaft hole finishing step is performed, the bending step is performed.

5. The method for manufacturing a motor vehicle door hinge according to claim 1, further comprising:

a bending step of bending the middle portion of the blank into an L shape after the shaft hole finishing step is performed; and a hole forming step of forming a hole in a flat portion of the blank without having the shaft hole formed therein by punching after the bending step is performed, the hole being used for attaching the motor vehicle door hinge to one of a vehicle body and a door.

6. A method for manufacturing a motor vehicle door hinge, comprising:

assembling the chassis-side door hinge that is to be attached to a vehicle body and the door-side door hinge that is to be attached to a door, both the chassis-side door hinge and the door-side door hinge being manufactured by the method according to claim 5, into a pair of motor vehicle door hinges by inserting a tubular plastic shock-absorbing member into the shaft hole of each of the door hinges, inserting a head hinge pin into the two tubular plastic shock-absorbing members and a washer so that the hinge pin penetrates the tubular plastic shock-absorbing members and the washer, and caulking an end of the head hinge pin.

7. A method for manufacturing a motor vehicle door hinge from a steel plate blank having predetermined thickness, width, and height using processes including cold heading and punching, the method comprising:

a cold heading step of forming, at one end of the blank in the width direction, a protrusion attached cylindrical bulging portion having a protrusion attached cylindrical bulging shape that bulges in the thickness direction so as to have a horizontal cross section of a circular shape or an elliptical shape and that extends in the height direction and having a protrusion on the top end of the circular shape or the elliptical shape by cold heading, the protrusion serving as a door stopper;

a shaft hole forming step of forming a shaft hole that passes through the protrusion attached cylindrical bulging portion along the shaft axis using a first punch and a first die, the shaft hole allowing a hinge pin to pass therethrough; and a shaft hole finishing step of punching the shaft hole formed in the shaft hole forming step from the end at which machining of the first punch ends using a second punch and a second die;

wherein the first punch used in the shaft hole forming step has a top end having a shape of a cone with a cone angle in the range from 70° to 120°, and wherein a height of the protrusion attached cylindrical bulging portion of the shaft hole formed in the shaft hole forming step is twice or more a diameter of the shaft hole, and wherein the first die has an inner wall having a gap relative to an outer circumferential surface of the protrusion attached cylindrical bulging portion of the blank, and wherein the size of a gap volume formed by the outer circumferential surface of the protrusion attached cylindrical bulging portion and the inner wall is set so that when the first punch punches the protrusion attached cylindrical bulging portion of the blank, a hole portion formed from an end at which machining of the first punch starts to a predetermined length position does not produce a punched slug and the protrusion attached cylindrical bulging portion bulges outward and a hole portion from the predetermined length position to the end at which the machining of the first punch ends produces a punched slug to be ejected, and wherein the second die has a shape substantially the same as the shape of the first die, and wherein the second punch has a top end having a shape of a truncated cone or a cone with a cone angle in the range from 70° to 120° and a largest diameter that is larger than that of the first punch by 0.1 mm to 0.3 mm.

8. The method for manufacturing a motor vehicle door hinge according to claim 7, further comprising;

an annealing step of performing one of spheroidizing annealing and soft annealing on the blank after the cold heading step and before the shaft hole forming step;

wherein the shaft hole forming step is performed by cold working.

9. The method for manufacturing a motor vehicle door hinge according to claim 7, wherein in the shaft hole forming step, the protrusion attached cylindrical bulging portion is subjected to warm working at a temperature in the range from 450° C. to 900° C.

10. The method for manufacturing a motor vehicle door hinge according to claim 7, further comprising:

a wall thickness increasing step of sandwiching the protrusion attached cylindrical bulging portion formed at one end of the blank by a split mold die having a back clearance that allows the middle portion of the blank to bulge in the thickness direction so that the other end protrudes from the split mold die and increasing a wall thickness of the middle portion of the blank by pressing the other end of the blank using a punch; and a bending step of bending a thick-wall portion of the blank formed in the wall thickness increasing step into an L shape using press working;

wherein the shaft hole forming step and the shaft hole finishing step are performed after the wall thickness increasing step is performed, and wherein after the shaft hole finishing step is performed, the bending step is performed.

11. The method for manufacturing a motor vehicle door hinge according to claim 7, further comprising:

a bending step of bending the middle portion of the blank into an L shape after the shaft hole finishing step is performed; and a hole forming step of forming a hole in a flat portion of the blank without having the shaft hole formed therein by punching after the bending step is performed, the hole being used for attaching the motor vehicle door hinge to one of a vehicle body and a door.

* * * * *